US006625247B1

(12) United States Patent
Ohsono et al.

(10) Patent No.: US 6,625,247 B1
(45) Date of Patent: Sep. 23, 2003

(54) CASK AND PRODUCTION METHOD OF CASK, AND EMBEDDED FORM

(75) Inventors: Katsunari Ohsono, Hyogo (JP); Kenji Najima, Hyogo (JP); Masaru Ohsaki, Hyogo (JP); Shinji Ohkame, Hyogo (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/658,571

(22) Filed: Sep. 8, 2000

(30) Foreign Application Priority Data

Sep. 9, 1999 (JP) ..... 11-256404

(51) Int. Cl.[7] ..... G21F 5/00

(52) U.S. Cl. ..... 376/272; 250/506.1; 250/515.1; 250/518.1

(58) Field of Search ..... 376/272, 462, 376/287, 347; 250/507.1, 506.1, 515.1, 518.1; 220/604, 606

(56) References Cited

U.S. PATENT DOCUMENTS

| | | | | |
|---|---|---|---|---|
| 3,731,101 A | | 5/1973 | Peterson et al. | 250/506.1 |
| 3,962,587 A | | 6/1976 | Dufrane et al. | 250/506.1 |
| 4,666,659 A | * | 5/1987 | Lusk et al. | 376/272 |
| 4,781,883 A | * | 11/1988 | Daugherty et al. | 376/272 |
| 5,063,299 A | | 11/1991 | Efferding | 250/507.1 |
| 5,373,540 A | | 12/1994 | DeCooman, Sr. et al. | 376/272 |
| 5,832,392 A | | 11/1998 | Forsberg | 250/506.1 |
| 5,844,245 A | * | 12/1998 | Brachet et al. | 250/506 |

FOREIGN PATENT DOCUMENTS

| | | |
|---|---|---|
| JP | 4-357498 | 12/1992 |
| JP | 9-159796 | 6/1997 |
| JP | 11-249314 | 9/1999 |
| WO | WO 95/26029 | 9/1995 |

* cited by examiner

*Primary Examiner*—Michael J. Carone
*Assistant Examiner*—David Matz
(74) *Attorney, Agent, or Firm*—Oblon, Spivak, McClelland, Maier & Neustadt, P.C.

(57) ABSTRACT

A lightweight cask comprises a barrel body which shields gamma rays. A resin which shields neutrons is provided on the periphery of the barrel body. A basket is made of a plurality of square pipes having neutron absorbing ability. There is a cavity inside the barrel body. This cavity is worked to have a shape corresponding to the outer shape of the basket. The square pipes are inserted in this cavity so as to abut against this inner surface. Furthermore, chamfered portions are provided on the outside surface of the barrel body at 90° intervals and space portions are formed between another resin and an outer casing.

15 Claims, 18 Drawing Sheets

CASK AND PRODUCTION METHOD OF CASK, AND EMBEDDED FORM

FIELD OF THE INVENTION

The present invention relates to a compact or lightweight cask and a production method of the cask, and to an embedded form. The cask is used for accommodating and storing spent fuel assemblies after combustion.

BACKGROUND OF THE INVENTION

A nuclear fuel assembly that has combusted to the final phase of the nuclear fuel cycle can not be used more and it is called used nuclear fuel. Such used nuclear fuel contains highly radioactive materials such as FP and thus needs to be cooled thermally. The used nuclear fuel is cooled in a cooling pit in the nuclear power plant for a predetermined period of time (three to six months). After that, the used nuclear fuel is accommodated in a cask which is a shielding vessel, and transported to a reprocessing plant e.g. by a truck and then stored. In accommodating used nuclear fuel assemblies in a cask, a holding element having a grid-like sectional shape referred to as a basket is used. The used nuclear fuel assemblies in question are inserted into cells which are a plurality of spaces formed in the basket in question, whereby an appropriate holding power against vibrations and the like is ensured during transportation. In the following discussion, a cask which forms a basis for developing the present invention will be described. The cask in question, however, is explained for the sake of convenience and does not fall into so-called well-known and well-used arts.

FIG. 17 is a perspective view showing one example of a cask. FIG. 18 is a radial section view of the cask shown in FIG. 17. The cask 500 comprises a cylindrical barrel body 501, a resin 502 which is a neutron shielding member disposed on the outer periphery of the barrel body 501, an outer casing 503 thereof, a bottom portion 504 and a lid portion 505. The barrel body 501 and the bottom portion 504 are casts of carbon steel which is a gamma ray shielding material. Further, the lid portion 505 consists of a primary lid 506 and a secondary lid 507. The barrel body 501 and the bottom portion 504 are connected by butt welding. The primary lid 506 and the secondary lid 507 are fixed with respect to the barrel body 501 via bolts of stainless and the like. Between the lid portion 505 and the barrel body 501 is disposed a metal O ring which keeps the interior air-tight.

Between the barrel body 501 and the outer casing 503 is provided a plurality of inner fins 508 for enabling heat conduction. The inner fins 508 are formed of copper so as to improve the heat conductivity. The resin 502 is injected into the spaces formed by these inner fins 508 in a fluid state, and then solidified by thermosetting reaction and the like. A basket 509 has a structure such that 69 square pipes 510 are assembled in a bundle as shown in FIG. 17, and is inserted into a cavity 511 of the barrel body 501. A basket 509 has a structure that 69 square pipes 510 are assembled in a bundle as shown in FIG. 17, and is inserted into a cavity 511 of the barrel body 501.

Reference numeral 515 designates a cell for accommodating a used nuclear fuel assembly. The relevant square pipe 510 is formed of an aluminum alloy mixed with a neutron absorbing material (boron: B) so that the inserted used nuclear fuel assembly will not go critical. On both sides of a cask body 512 are provided trunnions 513 (one of them is omitted) for suspending the cask 500. Furthermore, on both ends of the cask body 512 are mounted buffer members 514 (one of them is omitted) to which lumber and the like is incorporated as a buffer material.

It is to be noted that it is desired that the above-described cask 500 is compact and lightweight from the view point of easy handling at the time of transportation and space saving at the time of storage. However, according to the configuration of the above-mentioned cask 500, since the outermost square pipes 510 line contact with the inner surface of the cavity 511 to generate a space area S between the basket 509 and the cavity 511, the diameter of the barrel body 501 becomes large and the cask 500 becomes heavy.

For addressing this problem, the only thing that is necessary to reduce the weight of the cask 500 is to make the thickness of the barrel body 501 small because the amount of radiation that leaks outside the cask is restricted by the total amount of neutrons and gamma rays. However, since the barrel body 501 is also a gamma ray shielding member, the barrel body 501 is required to have sufficient thickness to ensure the gamma ray shielding ability. Even in such a case, the thickness should fall within the range that is necessary and sufficient to shield the gamma rays. This is because excess thickness will avoid reduction of weight of the cask.

SUMMARY OF THE INVENTION

It is an object of this invention to provide a cask which is compact and lightweight, a method for producing such cask, and an embedded form.

In order to solve the above problems, according to one aspect of this invention a cask comprises: a barrel body having an integrated forged structure and which shields gamma rays; a neutron shielding member provided outside said barrel body; and a basket having a cellular structure having an angular cross section, which cellular structure comprising cells each formed with a square shaped pipe which can shield neutrons; wherein a part or the whole of the outer shape of said barrel body is matched with a shape that is formed when the vertices of the angular cross section of said basket are connected, and wherein used fuel assemblies are accommodated and stored in said cells.

According to another aspect of this invention a cask comprises: a barrel body which shields gamma rays; a neutron shielding member provided outside said barrel body; and a basket having a cellular structure having plane sections and step-like sections, which cellular structure comprising cells each formed with a square shaped pipe which can shield neutrons; wherein a portion of the outer shape of said barrel body corresponding to the step-like sections of said basket is made of a shape such that it is parallel to a line that connects the vertices of the step-like sections of said basket, and wherein used fuel assemblies are accommodated and stored in said cells.

According to still another aspect of this invention a cask comprises: a barrel body which shields gamma rays; a neutron shielding member provided outside said barrel body; and a basket having a cellular structure having a angular cross section, which cellular structure comprising cells each formed with a square shaped pipe which can shield neutrons; wherein the internal shape of a cavity in said barrel body is matched with the outer shape of the angular cross section of said basket, said barrel body having an external shape having 8 or 12 corners, wherein some or all of the sides of said barrel body are made parallel to a line which connects the vertices of the angular cross section of said basket, and wherein used fuel assemblies are accommodated and stored in said cells.

In this cask, since the outside shape of the barrel body is matched to the outside shape of the basket, the portion having excess gamma ray shielding ability is removed, so that it is possible to reduce the weight of the barrel body. Moreover, by matching the shape of the neutron shielding member provided on the outer periphery of the barrel body to the outside shape of the barrel body, it is possible to make the cask compact.

In this connection, matching the outside shape of the barrel body to the outside shape of the basket means that the outside shape of the barrel body is appropriately formed within the range assumable by persons skilled in the art, for example, so as to have a shape corresponding to only large flat portion of the outside surface of the basket; so as to have a shape similar to that defined by connecting the apexes of the square pipes constituting the basket; or so as to have a shape strictly similar to the outside shape of the basket.

According to still another aspect of this invention a cask comprises: a barrel body which shields gamma rays; a neutron shielding member provided outside said barrel body; and a basket, having an angular cross section, formed by inserting a plurality of square shaped pipes which can shield neutrons into a cavity in said barrel body; wherein a part or a whole portion of the outer shape of said barrel body is made of a shape such that it is parallel to a line that connects the vertices of the angular cross section of said basket, and wherein the internal shape of said cavity is matched with the outer shape of said barrel, said basket is inserted into said cavity, and used fuel assemblies are accommodated and stored in said cells.

According to this cask, by matching the inside shape of the cavity to the outside shape of the basket, the outer diameter of the barrel body is decreased because the space area is bridged, however, the thickness is not uniform as a result of the above, the outside shape as well as the inside shape of the barrel body is matched to the outside shape of the basket. Therefore, the portion having excess gamma ray shielding ability is removed, so that it is possible to reduce the weight of the barrel body. Furthermore, since the size of the barrel body is reduced and thus the outer diameter of the neutron shielding member can be reduced, it is possible to make the cask compact.

In this connection, the meaning of matching the outside shape of the barrel body to the outside shape of the basket is as mentioned above, and also the inside shape of the cavity involves a shape not corresponding to the outside shape of the basket partly within the range of common sense in addition to a shape corresponding to the outside shape of the basket. By designing the barrel body to have the above-mentioned shapes, the outer square pipes come into surface contact with the inner surface of the cavity, so that the decay heat generated from the spent fuel assemblies in the cells is efficiently conducted from the cask to the barrel body. Moreover, since the square pipes have neutron absorbing ability, even when spent fuel assemblies are accommodated, they will not go critical.

Further, the shape of the neutron shielding member is matched to shape formed when the vertices of the angular cross section of said basket are connected, wherein said basket having a cellular structure having a angular cross section, which cellular structure comprising cells each formed with a square shaped pipe which can shield neutrons.

Further, the outside shape of the barrel body is matched to a shape formed when the vertices of the angular cross section of said basket are connected by providing a chamfer in the part where the thickness is sufficient to shield gamma rays in said barrel body, wherein said basket having a cellular structure having an angular cross section, which cellular structure comprising cells each formed with a square shaped pipe which can shield neutrons.

That is, by matching the shape of the neutron shielding 20 member to the outside shape of the basket, it is possible to make the cask more compact due to the synergistic effect of the shape of the barrel body. In addition, by matching the outside shape of the barrel body to the outside shape of the basket, a portion results where the neutron shielding member has excess thickness, however, by matching the neutron shielding member itself to the outside shape of the basket, it is possible to suitably reduce the usage of the neutron shielding member.

In this connection, matching the shape of the neutron shielding member to the outside shape of the basket means that the shape of the neutron shielding member is appropriately formed in a manner within the range assumable by persons skilled in the art, for example, so as to have a shape corresponding to only large flat portion of the outside surface of the basket; so as to have a shape similar to that defined by connecting the apexes of the square pipes constituting the basket; or so as to have a shape strictly similar to the outside shape of the basket.

Further, the outside shape of the barrel body is matched to a shape formed when the vertices of the angular cross section of said basket are connected by providing a chamfer in the part where the thickness is sufficient to shield gamma rays in said barrel body, wherein said basket having a cellular structure having a angular cross section, which cellular structure comprising cells each formed with a square shaped pipe which can shield neutrons.

Considering the fact that if the thickness is excess to shield gamma rays, the cask becomes heavy. Accordingly, the barrel body is provided with a chamfer so long as minimum gamma ray shielding ability is ensured. As a result of this, it is possible to make the cask lightweight and compact.

Further, the outside shape of the barrel body is matched to a shape formed when the vertices of the angular cross section of said basket are connected by providing an auxiliary shielding member in the part where the thickness is insufficient to shield gamma rays in said barrel body, wherein said basket having a cellular structure having a angular cross section, which cellular structure comprising cells each formed with a square shaped pipe which can shield neutrons.

Contrary to the method in which the barrel body is designed to have excess neutron shielding ability and the portion having excess neutron shielding ability is removed, it is also possible to prepare a barrel body having such a thickness that gamma ray shielding ability is partly insufficient, and to provide the auxiliary shielding member in the part having insufficient gamma ray shielding ability. Also with such a method, it is possible to make the cask lightweight and compact while ensuring a necessary gamma ray shielding ability as the entire barrel body.

According to still another aspect of this invention a cask comprises: a barrel body having an integrated forged structure and which shields gamma rays; a neutron shielding member provided outside said barrel body; and a basket having a cellular structure having a angular cross section, which cellular structure comprising cells each formed with a square shaped pipe which can shield neutrons; wherein the internal shape of a cavity in said barrel body is matched with the outer shape of the angular cross section of said basket, wherein the outside of said barrel body is machined to a shape having a enough necessary thickness to shield gamma rays when used fuel assemblies are accommodated and stored in said cells, and wherein used fuel assemblies are accommodated and stored in said cells.

According to a method of producing a cask of still another aspect, the cask having a barrel body for shielding gamma rays and an outer casing provided on the outside of the barrel body, for potting a neutron shielding member for shielding neutrons between the barrel body and the outer casing, an embedded form is arranged in the inner surface of the outer casing beforehand, and the embedded form is removed by heating after potting of the neutron shielding member, thereby forming an expansion margin or other space portions between the outer casing and the neutron shielding member.

Such a production method is concretely used for forming the neutron shielding member into the shapes as recited in the third and fifth aspects, and also can be used for forming an expansion margin which is provided between the neutron shielding member and the outer casing. For the embedded form, a hot melt adhesive based on, for instance, vinyl acetate is used. The heating condition may be entire heating of the cask or selective heating of the embedded form. By forming the neutron shielding member in this manner, it is possible to facilitate production of the cask.

An embedded form according to a still another aspect is a form arranged inside of an outer casing provided on the outside of a barrel body for shielding gamma rays, and for forming an expansion margin or other space portions to be formed between the outer casing and a neutron shielding member to be potted, and the form is formed of a thermoplastic material and a heater is embedded in the form.

The embedded form is arranged inside of the outer casing, and the neutron shielding member is potted between the barrel body and the outer casing in this state. Next, a heater provided for the embedded form is energized, thereby melting the thermoplastic material on the periphery and removing it from inside of the outer casing. As a result, it is possible to form the expansion margin or other space portions. By using this embedded form, molding of the neutron shielding member is facilitated, so that it is possible to produce the cask easily.

Next, an embedded form according to still another aspect is a form arranged inside of an outer casing provided on the outside of a barrel body for shielding gamma rays, and for forming an expansion margin or other space portions to be formed between the outer casing and a neutron shielding member to be potted, and the form is formed by providing a thermoplastic material around a metal core and a heater is embedded in the metal core.

Since the thermoplastic material is provided around the metal core, and the metal core is heated by the heater so that only the thermoplastic material around the metal core is melted, it is possible to easily recycle the form. Accordingly, the production efficiency of the cask can be improved.

Other objects and features of this invention will become apparent from the following description with reference to the accompanying drawings.

DESCRIPTION OF THE PREFERRED EMBODIMENTS

In the following discussion, embodiments of a cask and a production method of the cask, and an embedded form according to the present invention will be described in detail with reference to the drawings. It is noted that the present invention is not limited to these embodiments.

Figure 1:
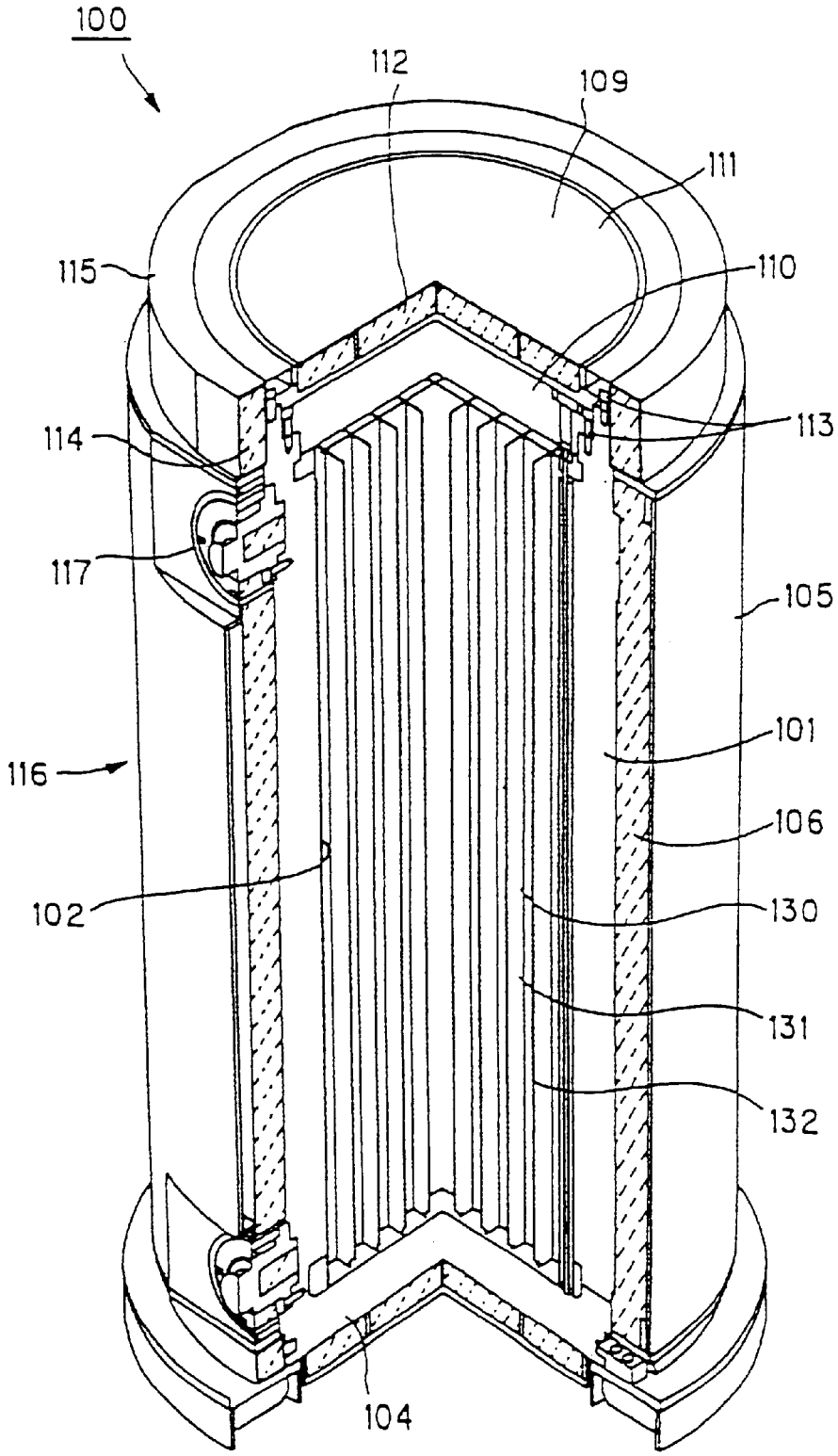
FIG. 1 is a perspective view showing the configuration of a cask according to a first embodiment of the present invention.
Figure 2:
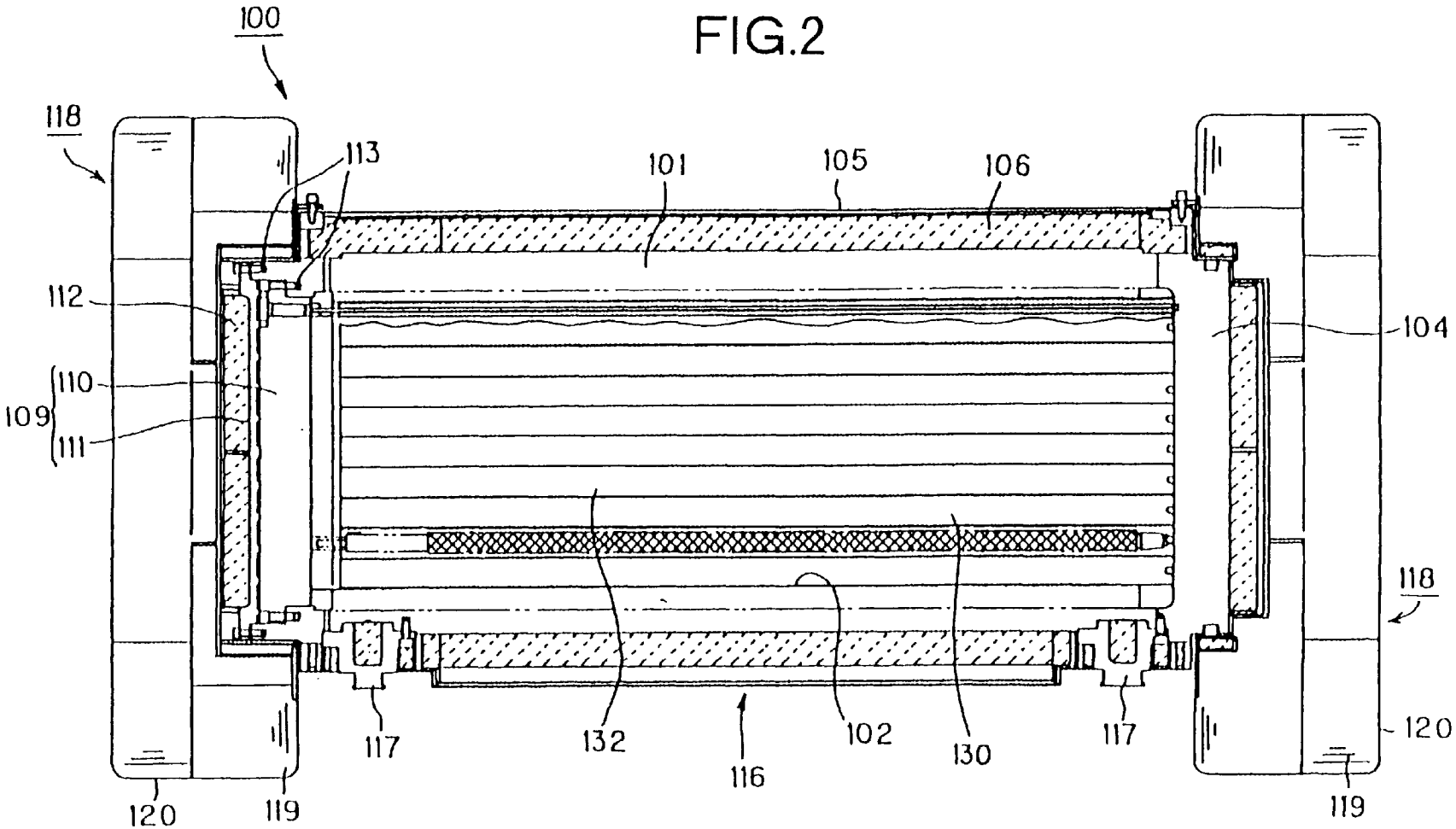
FIG. 2 is a radial section view of the cask shown in FIG. 1.
Figure 3:
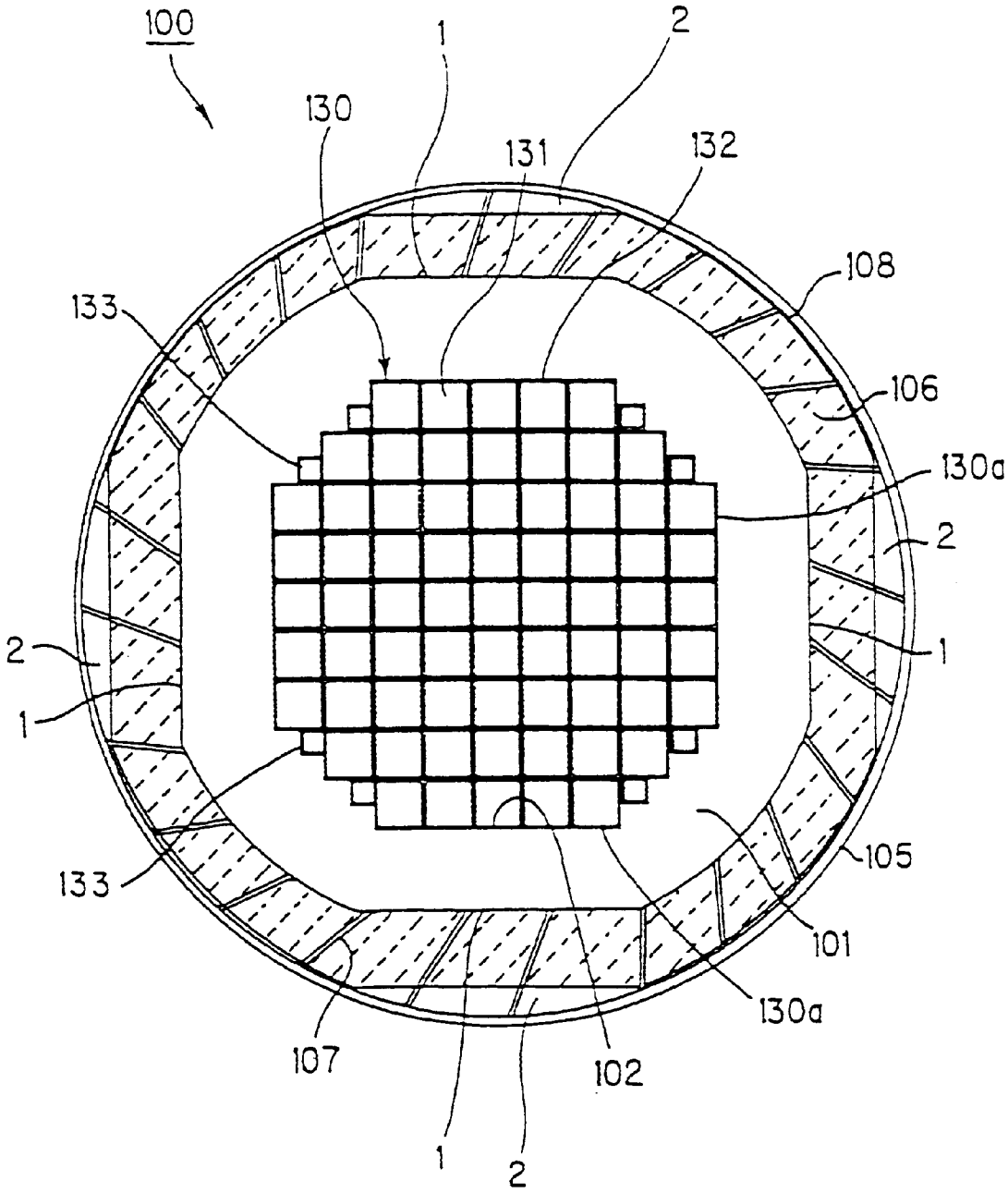
FIG. 3 is an axial section view of the cask shown in FIG. 1.

FIG. 1 is a perspective view showing a cask according to a first embodiment of the present invention. FIG. 2 is a radial sectional view of the cask shown in FIG. 1. FIG. 3 is an axial sectional view of the cask shown in FIG. 1. A cask 100 according to the first embodiment is formed by machining the inner surface of a cavity 102 of a barrel body 101 in agreement with the outside shape of a basket 130. The machining of the inner surface of the cavity 102 is made by the use of a special working apparatus as will be described below. The barrel body 101 and a bottom plate 104 are casts of carbon steel having gamma ray shielding ability. It is also possible to use stainless steel in place of the carbon steel. The barrel body 101 and the bottom plate 104 are connected by welding. Additionally, in order to ensure the hermeticity of a pressure-resistant container, between a primary lid 110 and the barrel body 101 is provided a metal gasket.

Between the barrel body 101 and an outer casing 105 is potted a resin 106 which is a polymeric material containing a high proportion of hydrogen and has neutron shielding ability. Furthermore, between the barrel body 101 and the outer casing 105, a plurality of inner fins 107 made of copper for performing heat conduction is welded, and the resin 106 is injected into spaces formed by these inner fins 107 in fluid form and solidified by thermosetting reaction and the like. It is preferable that the inner fins 107 are provided in higher density in the positions where the amount of heat is high so as to enable uniform radiation of the heat. Furthermore, between the resin 106 and the outer casing 105 is provided a heat expansion margin 108 of several mm.

A lid portion 109 consists of the primary lid 110 and a secondary lid 111. The primary lid 110 is made of stainless steel or carbon steel which shields gamma rays and is of a disc shape. The secondary lid 111 is also made of stainless steel or carbon steel and of a disc shape, and a resin 112 as a neutron shielding member is sealed in the upper face thereof. The primary lid 110 and the secondary lid 111 are mounted on the barrel body 101 by means of bolts 113 made of stainless steel or carbon steel. Furthermore, between each of the first lid 110 and the secondary lid 111, and the barrel by 101, a metal gasket for keeping the interior hermetically sealed is provided. Further, in the vicinity of the lid portion 109, an auxiliary shielding member 115 in which a resin 114 is sealed is provided.

On both sides of a cask body 116 are provided trunnions 117 for suspending the cask 100. FIG. 1 shows the case where the auxiliary shielding member 115 is provided, however, during transportation of the cask 100, the auxiliary shielding member 115 is removed and a buffer member 118 is mounted (See FIG. 2). The buffer member 118 has such a structure that a buffer material 119 such as lumber is incorporated into an outer casing 120 made of stainless steel and the like. A basket 130 consists of 69 square pipes 132 constituting cells 131 for accommodating spent fuel assemblies. The square pipes 132 are made of an aluminum composite material or aluminum alloy in which powder of B or B compound having neutron absorbing ability is added to powder of Al or Al alloy. Furthermore, as the neutron absorbing material, cadmium can be used besides boron.

Meanwhile, on the outside surface of the barrel body 101, four chamfered portions 1 are provided at 90° intervals. Each chamfered portion 1 is disposed so as to oppose to a flush portion 130*a* on the outside of the basket 130. The chamfered portion 1 is machined by a special working apparatus as will be described later. That portion has excess thickness thus excess gamma ray shielding ability before subjecting the machine work, however, by subjecting this portion to chamfering work, it is possible to make the thickness of the barrel body 101 substantially uniform and reduce the weight of the barrel body 101. Additionally, the gamma ray shielding ability is ensured in the range of necessary and sufficient.

The above-mentioned resin 106 is potted so as to intimately contact with the outside of the barrel body 101, while forming a space portion 2 between the outer casing 105 and the resin 106 at the position corresponding to the chamfered portion 1. This is because the resin 106 of that portion becomes thicker than needed by providing the chamfered portion 1 for the barrel body 101. By providing this space portion 2, it is possible to make the thickness of the resin 106 uniform and to equalize the neutron shielding ability, as well as to reduce the usage of the resin 106.

Figure 4:
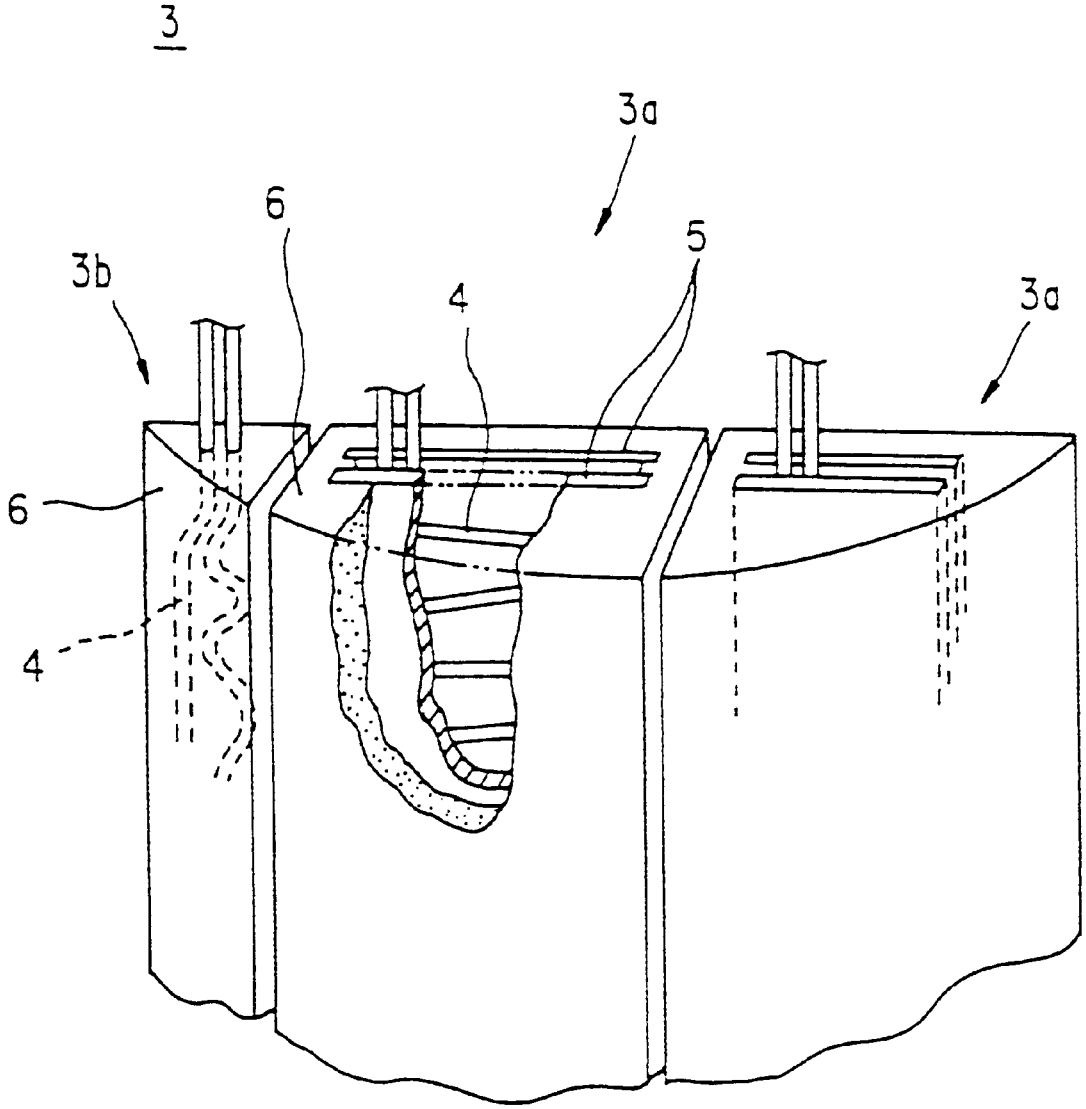
FIG. 4 is a perspective view showing an embedded form used for forming a space portion.

Next, methods for forming the heat expansion margin 108 and the space portion 2 will be described. FIG. 4 is a perspective view showing an embedded form for forming the space portion 2. This embedded form 3 has two types: an embedded form 3*a* in which a heater 4 is sandwiched between SUS plates 5, and a hot melt adhesive 6 (JET MELT EC-3762LM: manufactured by SUMITOMO 3M) which is a thermoplastic material is provided therearound; and an embedded form 3*b* in which the heater 4 itself is embedded in the hot melt adhesive 6. The hot melt adhesive 6 comprises vinyl acetate as a main component and has a viscosity at 120° C. of 4000 cps.

The shape of the embedded form 3 is determined based on the space portion 2 to be arranged. In this case, the space portion 2 is not filled with the resin 106, but the inner fins 107 penetrate therethrough for enabling heat conduction. Therefore, the shape of the embedded form 3 is also restricted by the inner fins 107 and the outer casing 105. In specific, as shown in FIG. 4, two embedded forms 3*a* having a metal core (SUS plate 5) and one embedded form 3*b* not having the metal core (5) are prepared for one space portion 2. In this connection, the embedded form 3*a* having the metal core (5) is used for ensuring large spaces, while the embedded form 3*b* not having the metal core (5) is used for ensuring small spaces. Since the embedded form 3*a* has the metal core (5), it has the advantage that the usage of the hot melt adhesive 6 can be reduced and that it can be preferably recycled.

Figure 5:
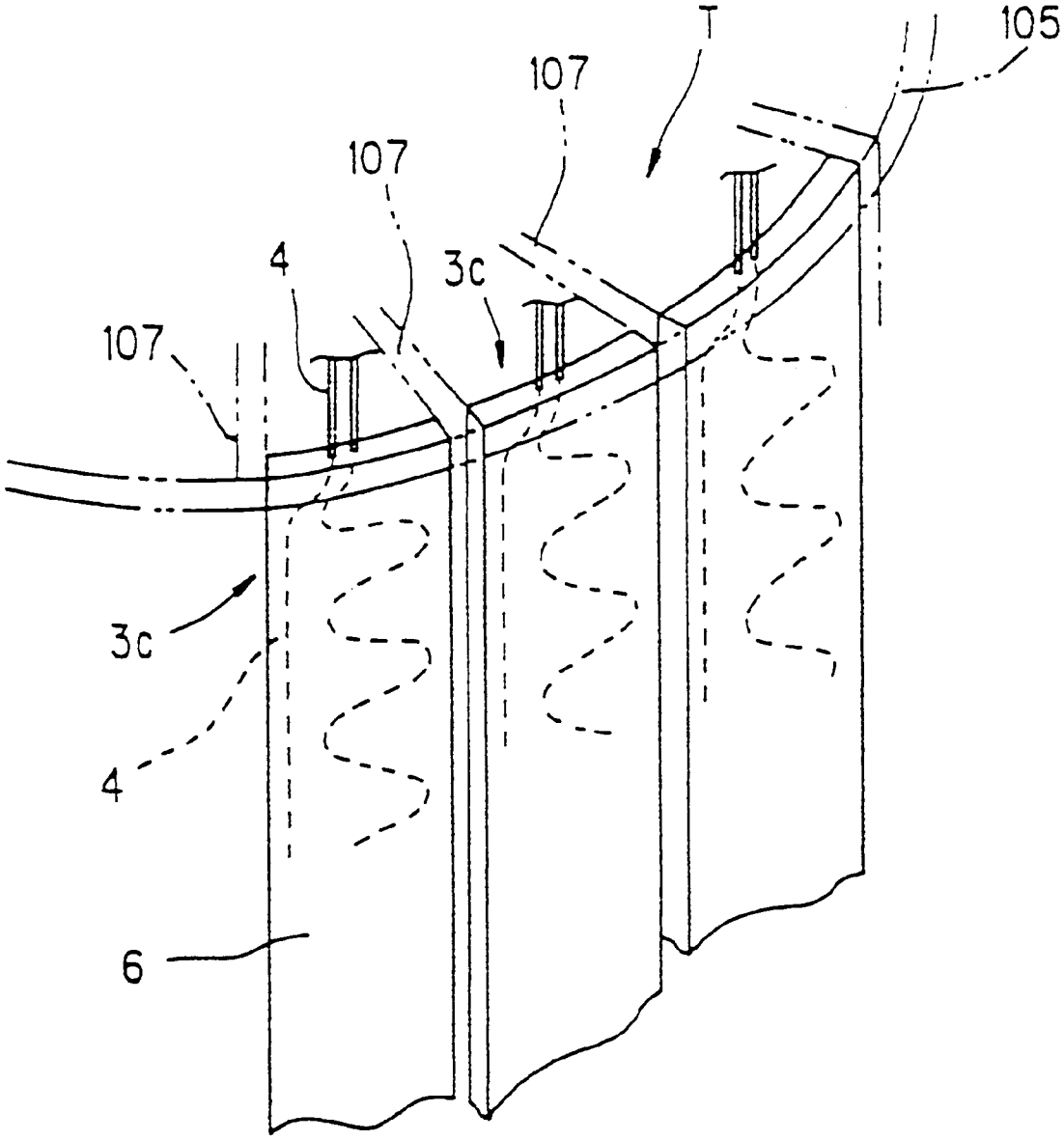
FIG. 5 is a perspective view showing an embedded form used for forming an expansion margin.

FIG. 5 is a perspective view showing an embedded form used for forming a heat expansion margin. This embedded form 3*c* is so configured that the hot melt adhesive 6 is formed in sheet-like shape and the heater 4 is embedded therein. This embedded form 3*c* is arranged by spreading on the inner surface of the outer casing 105 between the inner fins 107.

After setting the embedded forms 3*a*, 3*b* for the space portion 2 and the embedded form 3*c* for the heat expansion margin, spaces T formed by the barrel body 101, the outer casing 105 and the inner fins 107 are successively potted with the resin 106 in fluid form, to thereby embedding the embedded form 3. Subsequently, after the resin 106 has solidified, the temperature is raised to 140° C. by energizing the heater 4. As a result of this, the hot melt adhesive 6 melts to flow out of the lower part of the cask body 116. In this connection, during resin molding, the bottom plate 104 is not mounted on the cask body 116. Through the above process, it is possible to form the space portion 2 and the heat expansion margin 108 between the resin 106 and the outer casing 105.

Incidentally, in case there remains a residue after removing the hot melt adhesive 6 by melting, it is preferable to perform finishing by using an apparatus that conducts aspiration while exposing the object to hot air. Meanwhile, as the thermoplastic material, polyethylene, polypropylene, polystyrene, methacrylic resin, nylon and the like that are known as thermoplastic materials can be appropriately used other than the hot melt adhesive 6.

Figure 6:
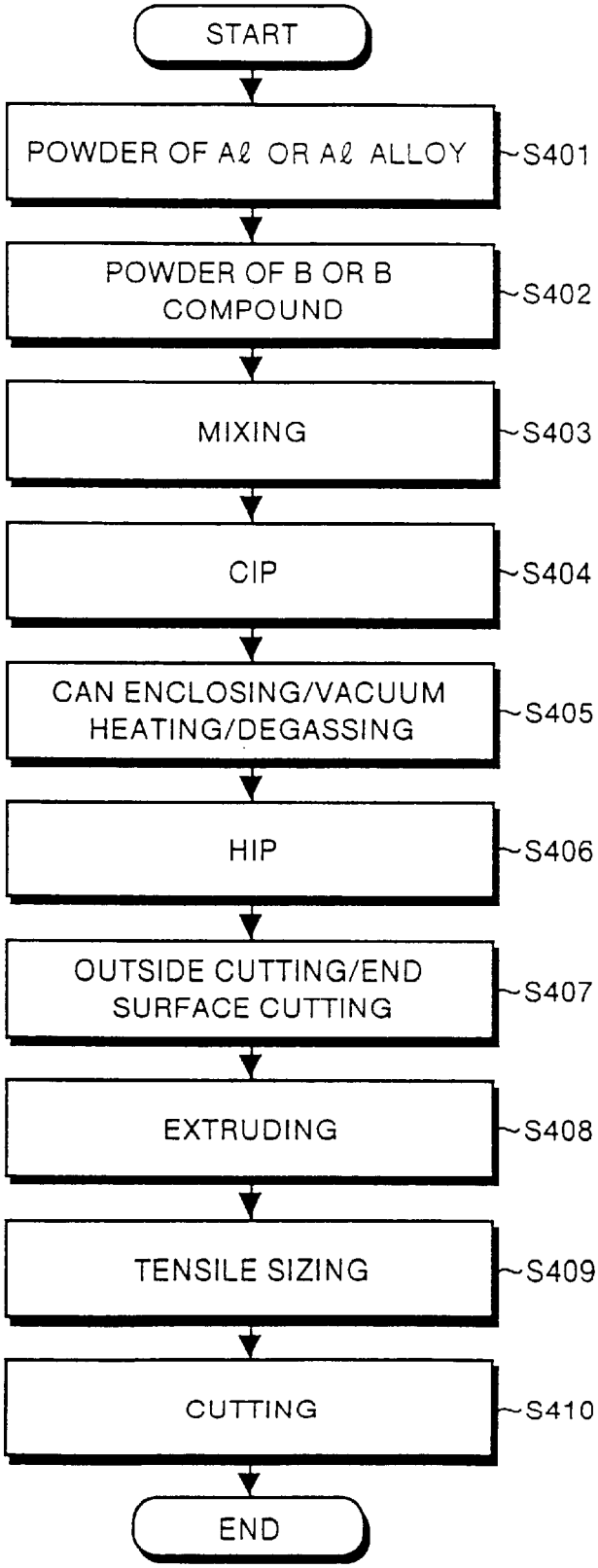
FIG. 6 is a flow chart showing a production method of a square pipe.

FIG. 6 is a flow chart showing a production method of the above-mentioned square pipe. At first, powder of Al or Al alloy is prepared by a quench solidifying method such as atomizing method (step S401), while preparing powder of B or B compound (step S402), and then the both particles are mixed for 10 to 15 minutes by a cross rotary mixer and the like (step S403).

As the Al or Al alloy, it is possible to use a pure aluminum base metal, Al—Cu group aluminum alloys, Al—Mg group aluminum alloys, Al—Mg—Si group aluminum alloys, Al—Zn—Mg group aluminum alloys, Al—Fe group aluminum alloys and the like. On the other hand, as the B or B compound, it is possible to use $B_4C$, $B_2O_3$ and the like. The amount of boron to be added with respect to aluminum is preferably not less than 1.5% by weight and not more than 7% by weight. This range is based on the fact that if the amount is 1.5% by weight or less, it is impossible to achieve sufficient neutron absorbing ability, while on the other hand if the amount is more than 7% by weight, elongation in response to tension will be deteriorated.

Next, the mixed powder is enclosed in a rubber case, to which high pressure is uniformly applied from every direction at atmospheric temperatures by CIP (Cold Isostatic Press) for powder molding (step S404). The molding condition of CIP is such that the molding pressure is 200 Mpa, the outer diameter and the length of a molded product are 600 mm and 1500 mm, respectively. By uniformly applying pressure from every direction by the use of the CIP, it is possible to obtain a molded product having high density and less variations in mold density.

Subsequently, the powder molded product is vacuum-sealed in a can, and the temperature is raised to 300° C. (step S405). Bas components and water in the can are removed at this degassing step. At next step, the molded product HIP degassed under vacuum is remolded by the HIP (Hot Isostatic Press) (step S406). The molding condition of the HIP is such that the temperature is 400° C. to 450° C., the time is 30 sec, the pressure is 6000 t and the outer diameter of the molded product becomes 400 mm. Subsequently, outside cutting and end surface cutting are conducted so as to remove the can (step S407), and the corresponding billet is hot extruded by using a port hole extruder (step S408). The extrusion condition in this case is such that the heating temperature is 500° C. to 520° C., and the extrusion speed is 5 m/min. The extrusion condition varies depending on the content of B.

Figure 7:
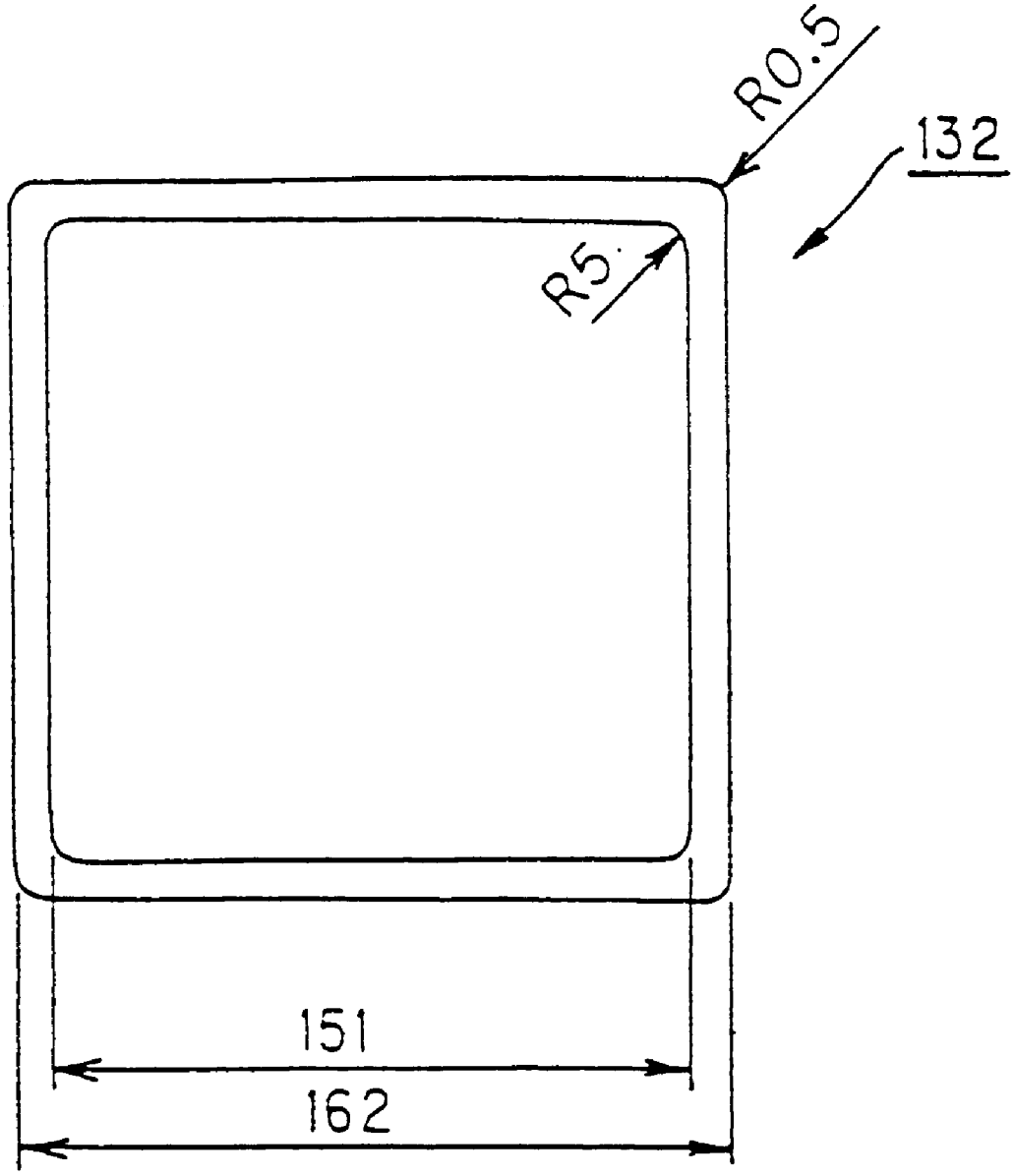
FIG. 7 is an explanatory view showing a sectional shape of the square pipe.

Next, after the extrusion molding, tensile sizing is conducted (step S409) and an unsteady portion and an evaluation portion are cut out to complete the product (step S410). The completed square pipe has a square shape as shown in FIG. 7 of which one side of the cross section is 162 mm and the inside is 151 mm. The dimension is held to a minus tolerance of 0 in view of required specifications. In addition, while R of the inner angle is 5 mm, the outer angle is formed into a sharp edge having an R of 0.5 mm.

In the case where R of the edge portion is large, when stress is applied to the basket 130, stress concentration occurs in a certain part (vicinity of the edge) of the square pipe 132, which may cause breakage. For this reason, by designing the square pipe 132 to have a sharp edge, a load is directly transmitted to the neighboring square pipe 132, so that it is possible to prevent the stress from concentrating in a certain part of the square pipe 132.

Figure 8:
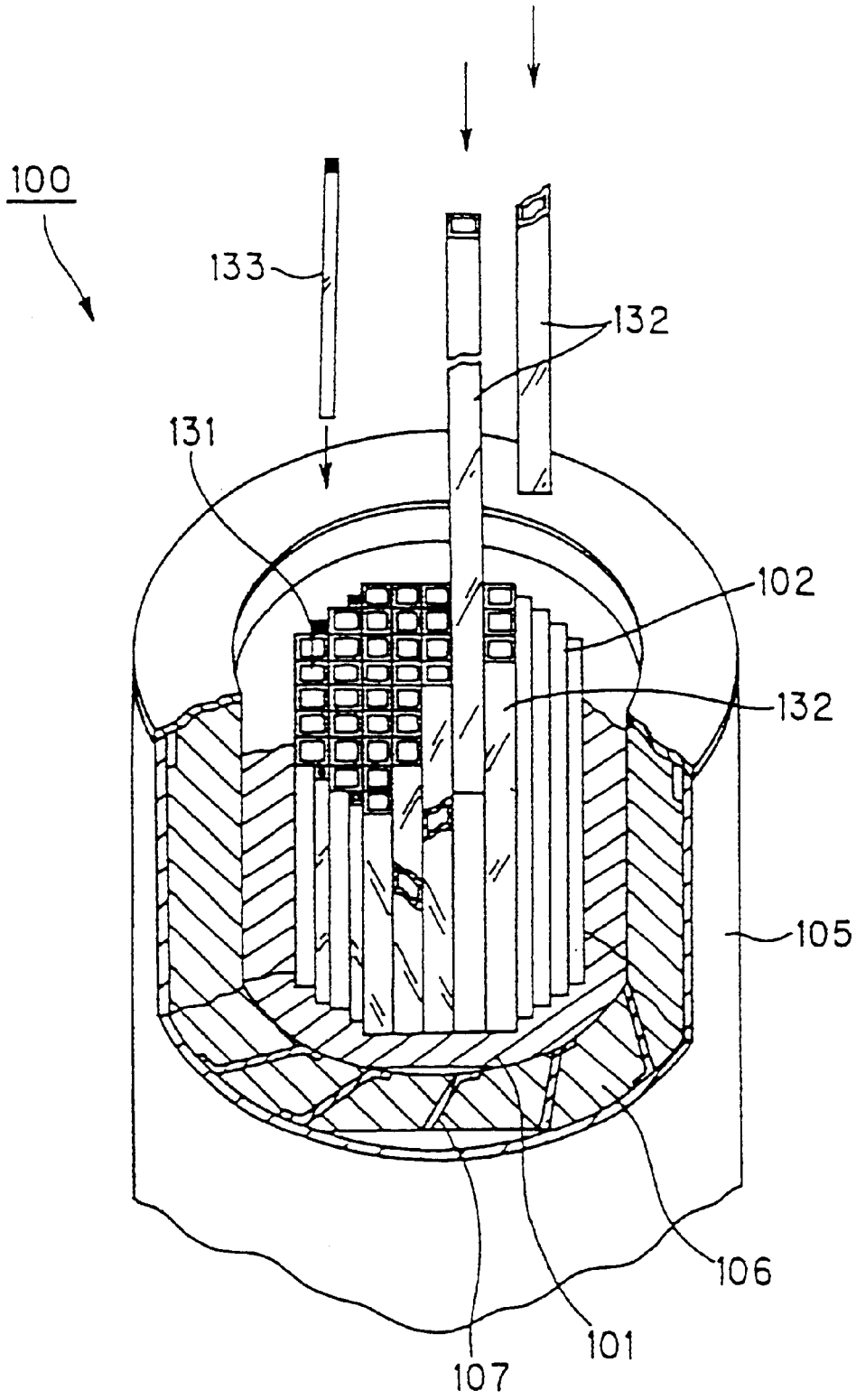
FIG. 8 is a perspective view showing an insertion method of the square pipe.

FIG. 8 is a perspective view showing an insertion method of the square pipe. The square pipes 132 produced by the above-mentioned process are inserted in turn according to the worked shape within the cavity 102. In connection of this, if there occur a bend and a twist on the square pipe 132, the square pipes 132 are difficult to be inserted when they are tried to be inserted appropriately because of accumulation of tolerances and influence by the bends due to the fact that the minus tolerance of dimension is 0. And if they are tried to be inserted forcefully, excess loads are applied to the square pipes 132. In view of the above, bends and twists of all or part of the produced square pipes 132 are measured beforehand by a laser measuring apparatus and the like and appropriate insertion positions are computed based on the measured data by the use of a computer. In this way, it is possible to readily insert the square pipes 132 into the cavity 102, as well as to make the stress applied to each square pipe 132 uniform.

Furthermore, as shown in FIGS. 8 and 3, on both sides of a square pipe line constituting 5 or 7 cells in the cavity 102 are inserted dummy pipes 133. The dummy pipe 133 is directed to make the thickness of the barrel body 101 uniform as well as to reduce the weight of the barrel body 101, while securing the square pipes 132 with accuracy. This dummy pipe 133 is also made of an aluminum alloy containing boron, and produced by the similar process as described above. This dummy pipe 133 may be omitted.

Figure 9:
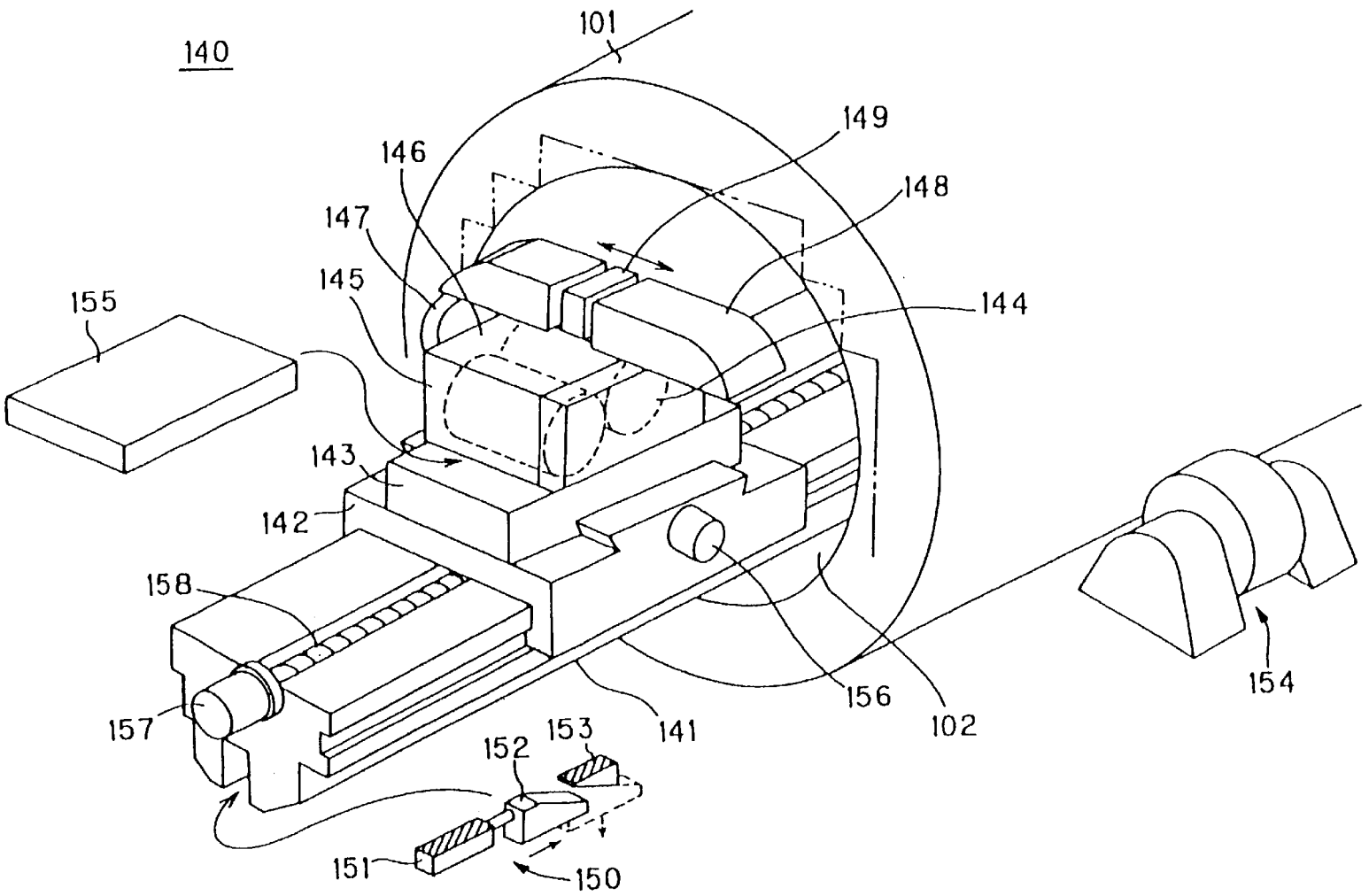
FIG. 9 is a schematic perspective view showing a working apparatus of a cavity.

Next, work with respect to the cavity 102 of the barrel body 101 will be described. FIG. 9 is a perspective view showing a working apparatus for the cavity 102. This working apparatus 140 comprises a stationary table 141 which is penetrated through the barrel body 101 and placed and fixed in the cavity 102; a movable table 142 which slides in the axial direction on the fixed table 141; a saddle 143 positioned and fixed on the movable table 142; a spindle unit 146 consisting of a spindle 144 and a driving motor 145 disposed on the saddle 143; and a face mill 147 provided on the spindle shaft. On the spindle unit 146 is provided a reaction force receiver 148 of which abutting portion is formed in accordance with the inner peripheral shape of the cavity 102. The reaction force receiver 148 is removable and slides along a dovetail groove (omitted in the drawing) in the direction of the arrow seen in the drawing. Also the reaction force receiver 148 has a clamp device 149 for the spindle unit 146 to enable fixation at a predetermined position.

Furthermore, in an under groove of the stationary table 141, a plurality of clamp units 150 are attached. The clamp unit 150 comprises a hydraulic cylinder 151, a wedge-like movable block 152 disposed on the shaft of the hydraulic cylinder 151 and a stationary block 153 abutting on the movable block 152 at an inclined surface, and attached to the inner surface of the groove of the stationary table 141 on the diagonally shaped side in the drawing. Driving the shaft of the hydraulic cylinder 151 causes the movable block 152 to abut with the stationary block 153, resulting in that the movable block 152 is moved downward to some degree due to the effect of the wedge (designated by the dotted line in the drawing). As a result, the lower surface of the movable block 152 is pressed against the inner surface of the cavity 102, so that it is possible to fix the stationary table 141 within the cavity 102.

Meanwhile, the barrel body 101 is placed on a rotary supporting base 154 comprising a roller, and is able to rotate in the radial direction. Providing a spacer 155 between the spindle unit 146 and the saddle 143 makes it possible to adjust the height of the face mill 147 on the stationary table 141. The thickness of the spacer 155 is the same as one side of the square pipe 132 in dimension. The saddle 143 is moved in the radial direction of the barrel body 101 by rotating a handle 156 provided for the movable table 142. Movement of the movable table 142 is controlled by a servo motor 157 provided on an end of the stationary table 141 and a ball screw 158. Since the inside shape of the cavity 102 varies as the work proceeds, the shapes of the reaction force receiver 148 and the movable block 152 of the clamp mechanism 150 are changed appropriately.

Figure 10A:
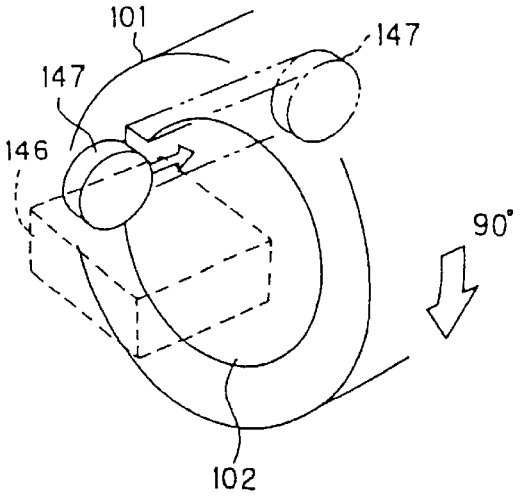
FIG. 10A to FIG. 10D are schematic perspective views showing working method of a cavity.
Figure 10B:
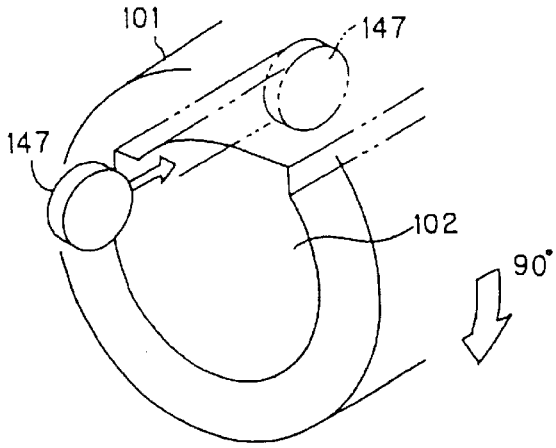

FIG. 10A to FIG. 10D are schematic explanatory views showing working processes of the cavity. At first, the stationary table 141 is secured at a predetermined position in the cavity 102 by the clamp unit 150 and the reaction force receiver 148. Next, as shown in FIG. 10A, the spindle unit 146 is moved at a predetermined cutting speed along the stationary table 141, and then cutting work within the cavity 102 is effected by the face mill 147. After completion of the cutting work at the position in question, the clamp unit 150 is removed to release the stationary table 141. Next, as shown in FIG. 10B, the barrel body 101 is turned 90 degrees on the rotary supporting base 154, and the stationary table 141 is fixed by the clamp unit 150. Then similar to the above described procedure, cutting work is effected by the face mill 147. After that the process as described above is repeated two more times.

Figure 10C:
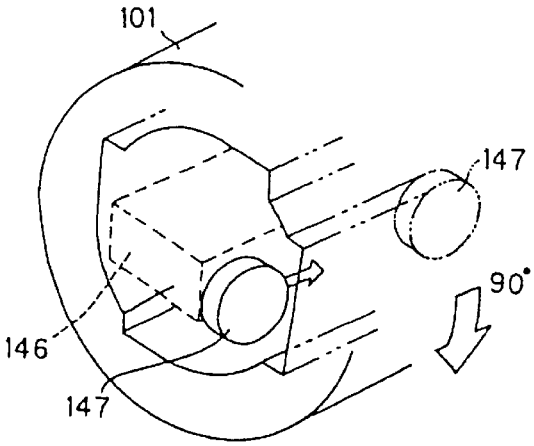
Figure 10D:
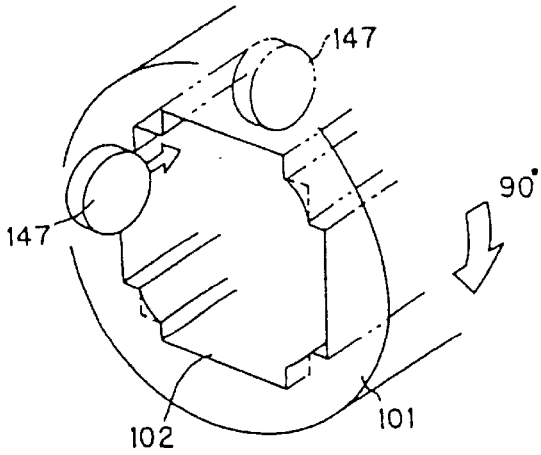

Next, the spindle unit 146 is turned 180 degrees, and cutting work within the cavity 102 is effected successively as shown in FIG. 10C. Also in this case, similar to the above, the cutting work is repeated while rotating the barrel body 101 90 degrees. Next, as shown in FIG. 10D, the position of the spindle unit 146 is elevated by applying the spacer 155 to the spindle unit 146. Then at this position, the face mill 147 is fed in the axial direction, thereby effecting cutting work within the cavity 102. By repeating the above step while rotating 90 degrees, the shape that is need to accommodate the square piper 132 is substantially completed. Cutting of the portion to which the dummy pipe 133 is to be inserted is also effected in the same way as shown in FIG. 10D. However, the thickness of the spacer for adjusting the height of the spindle unit 146 is designed to be equal to one side of the dummy pipe 133.

Figure 11:
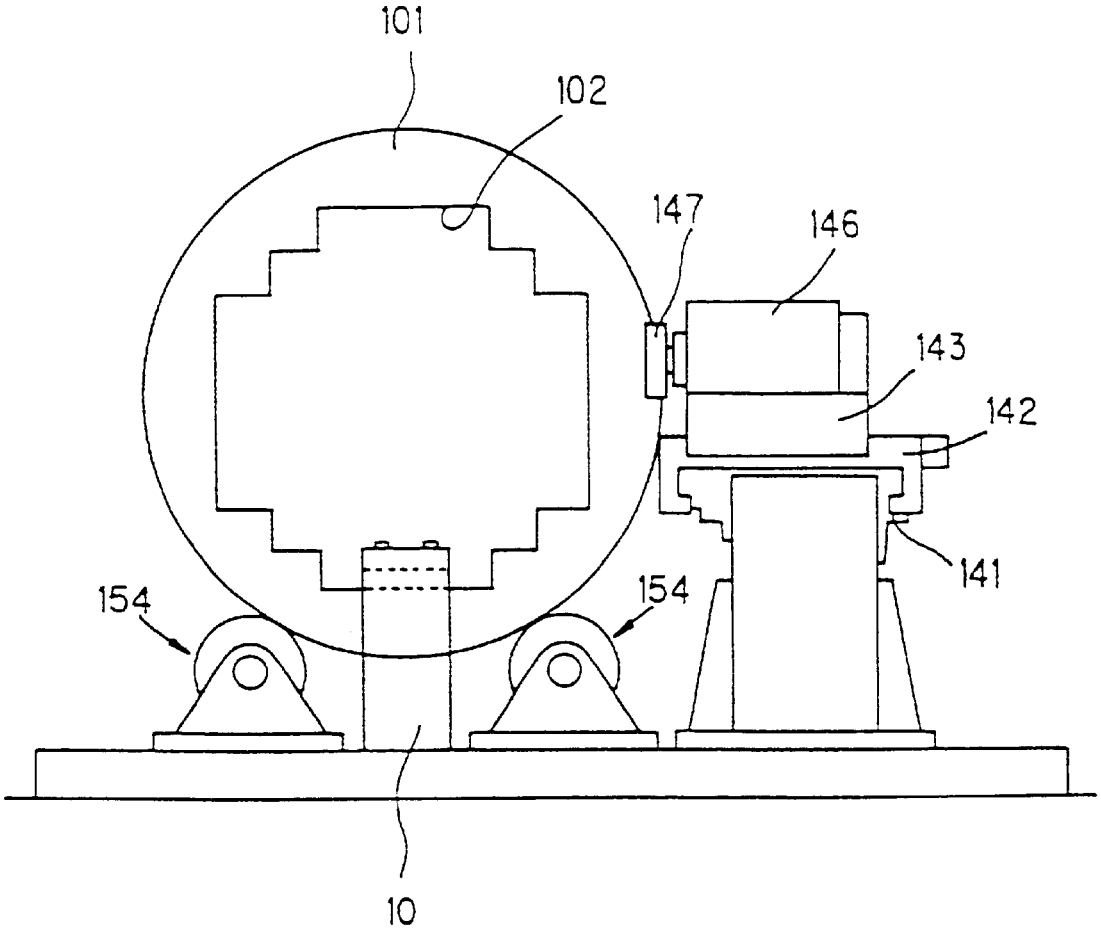
FIG. 11 is a explanatory view showing a working method of a chamfered portion of a barrel body.

Additionally, in the case where the chamfered portion 1 of the barrel body 101 is milled, as shown in FIG. 11, the barrel body 101 is secured on the rotary supporting base 154 by a special clamp device 10, and the spindle unit 146 incorporated with the stationary table 141 is arranged on the side of the barrel body 101. Under this condition, the face mill 147 is fed in the axial direction, and cutting work is effected on the chamfered portion 1 of the barrel body 101. After completion of working on one chamfered portion 1, similar to the above, the clamp device 10 is removed and the barrel body 101 is rotated 90 degrees, and the cutting work is continued. This process is repeated two more times to finish the work for the chamfered portion 1 of the barrel body 101.

Since spent fuel assemblies to be accommodated in the cask 100 contain fissile materials, fission products and the like and therefore generate radiation and involve decay heat, it is necessary to reliably keep the heat removing ability, shielding ability and criticality preventing ability of the cask 100 during a storage period. In the cask 100 according to the first embodiment, the inside of the cavity 102 of the barrel body 101 is machine worked so that outside of the basket 130 consisting of the square pipes 132 is inserted in a contact state (without space area), and moreover the inner fins 107 are provided between the barrel body 101 and the outer casing 105. Therefore, the heat from a fuel bar is transmitted to the barrel body 101 via the square pipe 132 or helium gas filled therein, to be emitted from the outer casing 105 mainly through the inner fins 107. Accordingly, removal of the decay heat is efficiently conducted, so that it is possible to keep the temperature within the cavity 102 lower than that in the conventional case for the same amount of decay heat.

Furthermore, gamma rays generated from a spent fuel assembly are shielded by the barrel body 101, the outer casing 105, the lid portion 109 and the like made of carbon steel or stainless steel. On the other hand, neutrons are shielded by the resin 106, thereby eliminating the affect of exposure to the radiation operator. In specific, the design is made to obtain shielding ability such that the surface dose equivalent rate is not more than 2 mSv/h and the dose equivalent rate at the position of 1 m from the surface is not more than 100 $\mu$Sv/h. Furthermore, since the square pipes 132 constituting the cells 131 are made of an aluminum alloy containing boron, it is possible to prevent the spent fuel assemblies from absorbing neutrons to go critical.

As described above, according to the cask 100 of the first embodiment, since the inside of the cavity 102 of the barrel body 101 is machine worked so that the square pipes 132 constituting the outer periphery of the basket 103 are inserted in contact state, it is possible to improve the heat conduction from the square pipes 132. Furthermore, since a space area within the cavity 102 is eliminated, it is possible to make the barrel body 101 compact and lightweight. Even in such a case, the number of accommodations for the square pipes 132 is not reduced. To the contrary, if the outer diameter of the barrel body 101 is made equal to that of the cask shown in FIG. 17, the number of cells can be kept accordingly, so that it is possible to increase the number of accommodation of the spent fuel assemblies.

Moreover, since the barrel body 101 is provided with the space portion 2 as well as the chamfered portion 1 and the resin 106 is formed so as to match with the outside shape of the barrel body 101, it is possible to further reduce the weight of the cask 100 while ensuring the necessary and sufficient thickness required for radiation shielding. Concretely, the cask 100 in question in which the outer diameter of the cask body 116 is, for instance, 2560 mm and the weight is suppressed to 120 tons satisfies the required design condition (the outer diameter of the cask body is no more than 2764 mm, and the weight is no more than 125 tons), while making it possible to increase the number of accommodation of the spent fuel assemblies to up to 69.

Figure 12A:
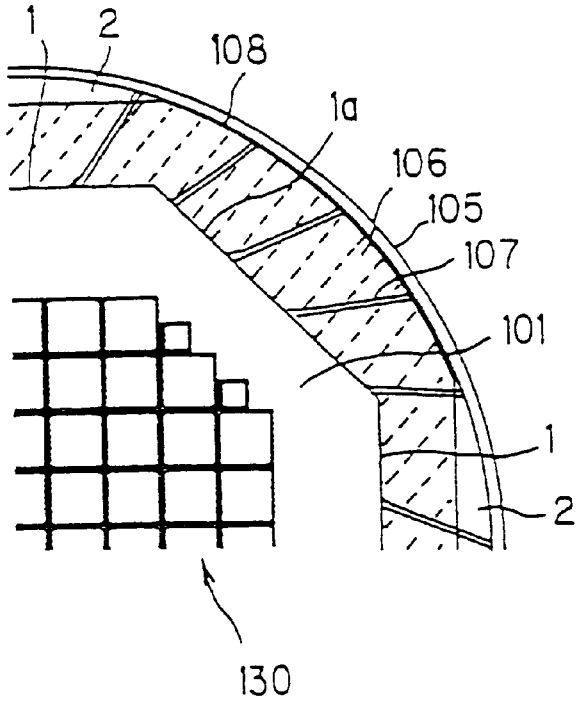
FIG. 12A and FIG. 12B are radial sectional views showing alternative example of the cask.
Figure 12B:
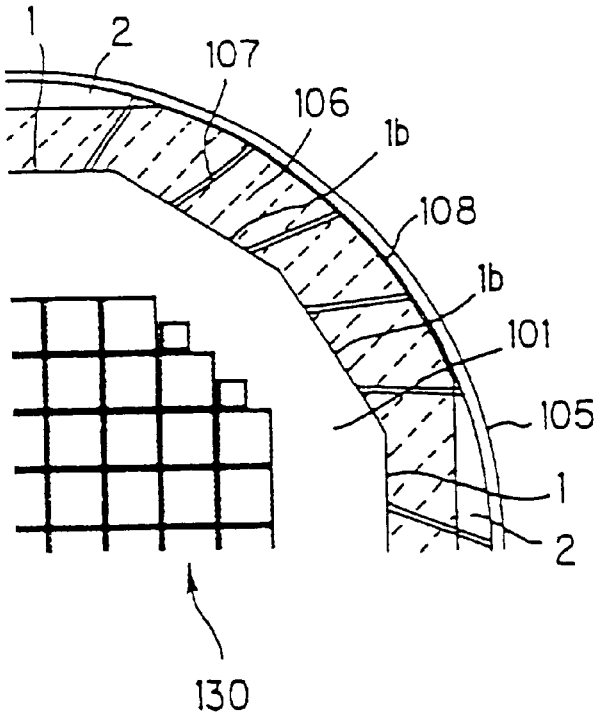

Next, an alternative of the cask according to the first embodiment will be described. FIG. 12A and FIG. 12B are radial sectional views showing alternatives of the cask. In the above-mentioned cask 100, the chamfered portions 1 of the barrel body 101 are disposed every 90° in four positions, however, as shown in FIG. 12A, it is possible to provide chamfered portions 1, 1*a* every 45° to make the barrel body 101 into octagon. In addition, it is also possible to provide the resin 106 with a space portion corresponding to each chamfered portion 1 though it will increase the thickness of the resin 106 (omitted in the drawing). Alternatively, as shown in FIG. 12B, the curved surface of the barrel body 101 may be formed into two chamfered portions 1*b*. In both cases, it is possible to make the outside shape of the barrel body 101 corresponding to the outside shape of the basket 130, so that it is possible to make the cask 100 more compact and lightweight.

Figure 13:
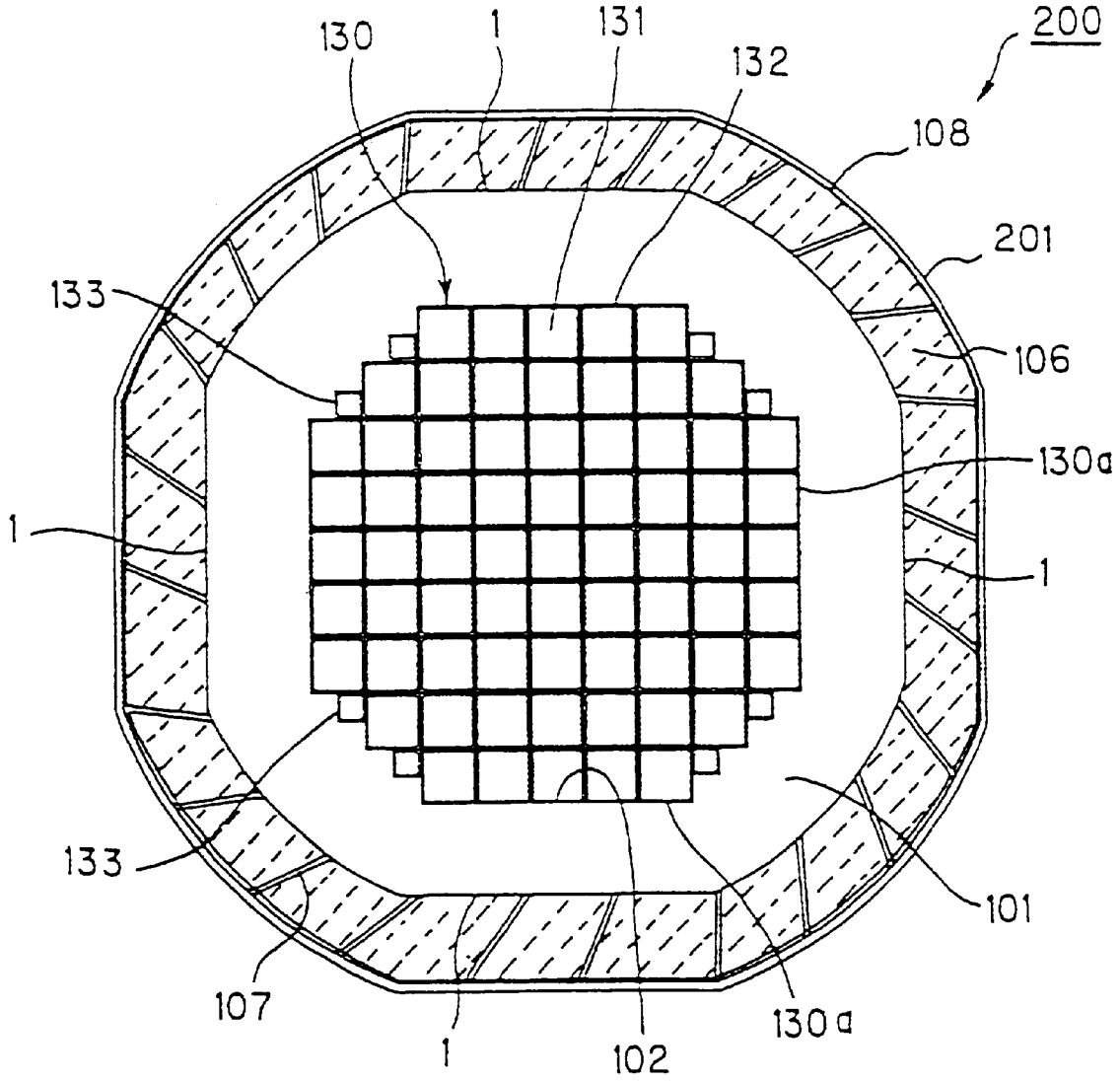
FIG. 13 is a radial section view showing another alternative example of the cask.

FIG. 13 is a radial sectional view showing another alternative of the cask. It is also possible to omit the above-mentioned space portion 2 by changing the shape of an outer casing 201 as in this cask 200. In the actual manufacturing process, since the barrel body 101 and the outer casing 201 are connected by the inner fins 107 before filling with the resin 106, the resin 106 can be potted directly. Therefore, the necessity of the embedded form 3 for forming the space portion as described above is eliminated. However, in order to form the heat expansion margin 108 for absorbing heat expansion of the resin 106, the sheet-like embedded form is still necessary. According to the above configuration, it is possible to make the cask 200 more compact.

Figure 14:
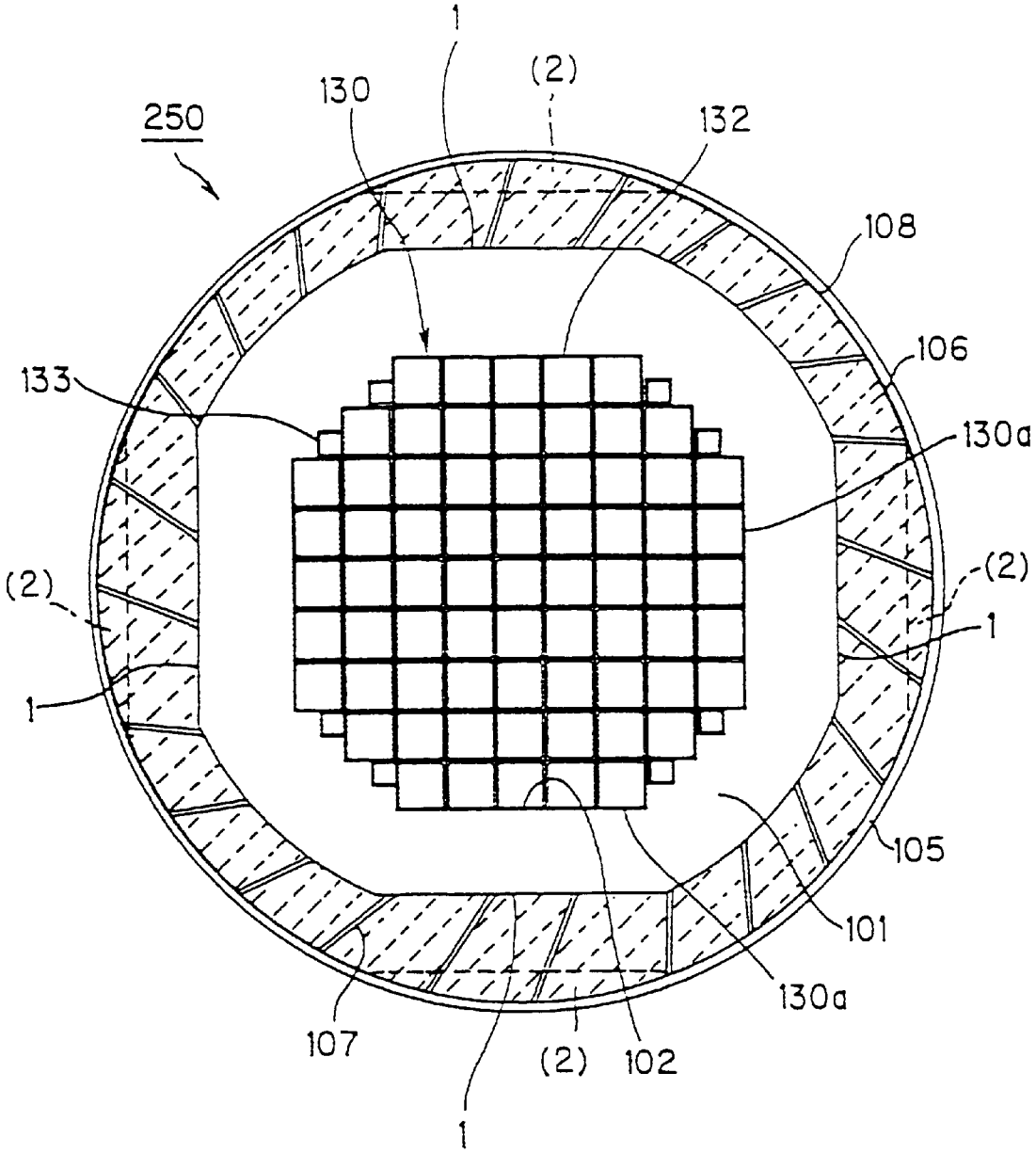
FIG. 14 is a radial section view showing yet another alternative example of the cask.

Further, formation of the space portion 2 can be omitted. FIG. 14 shows a radial section view of a cask 250 having such a configuration. Due to the fact that in the above-mentioned cask 100 the barrel body 101 is made of carbon steel or stainless steel and the resin 106 is made of polymeric materials, the most important factor from the viewpoint of reduction of weight is the shape of the barrel body 101. In view of this, formation of the space portion 2 of the resin 106 is omitted and thereby the manufacturing process is simplified. According to the cask 250 of such configuration, it is possible to simplify the manufacturing process as well as to reduce the weight of the cask 250.

Figure 15:
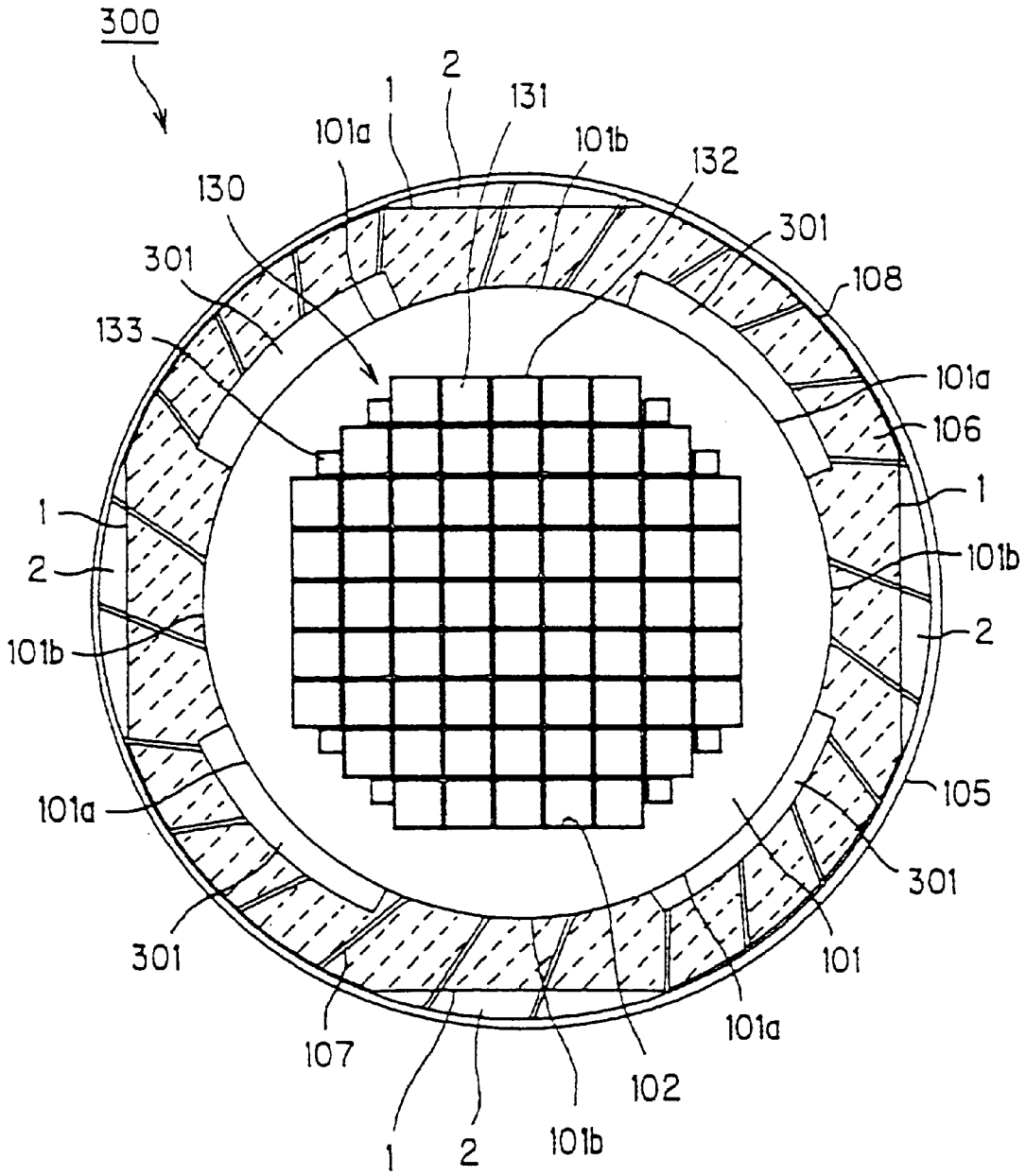
FIG. 15 is a radial section view showing a cask according to a second embodiment of the present invention.

FIG. 15 is a radial section view showing a cask according to the second embodiment of the present invention. This cask 300 is characterized in that an auxiliary shielding member 301 is provided at a portion 101*a* where the gamma ray shielding ability of the barrel body 101 is insufficient, thereby ensuring a predetermined thickness. That is, a portion 101*b* where the auxiliary shielding member 301 is not formed substantially corresponds to the chamfered portion 1 in the cask 100 of the first embodiment. The auxiliary shielding member 301 is made of carbon steel or stainless steel the same as the barrel body 101 and is produced by casting, forging or machine working. Other configuration is as same as that of the cask 100 of the first embodiment, so that the description thereof is omitted and the same elements are denoted by the same reference numerals. According to this cask 300, similar to the above, it is possible to make the cask 300 compact and lightweight.

Figure 16:
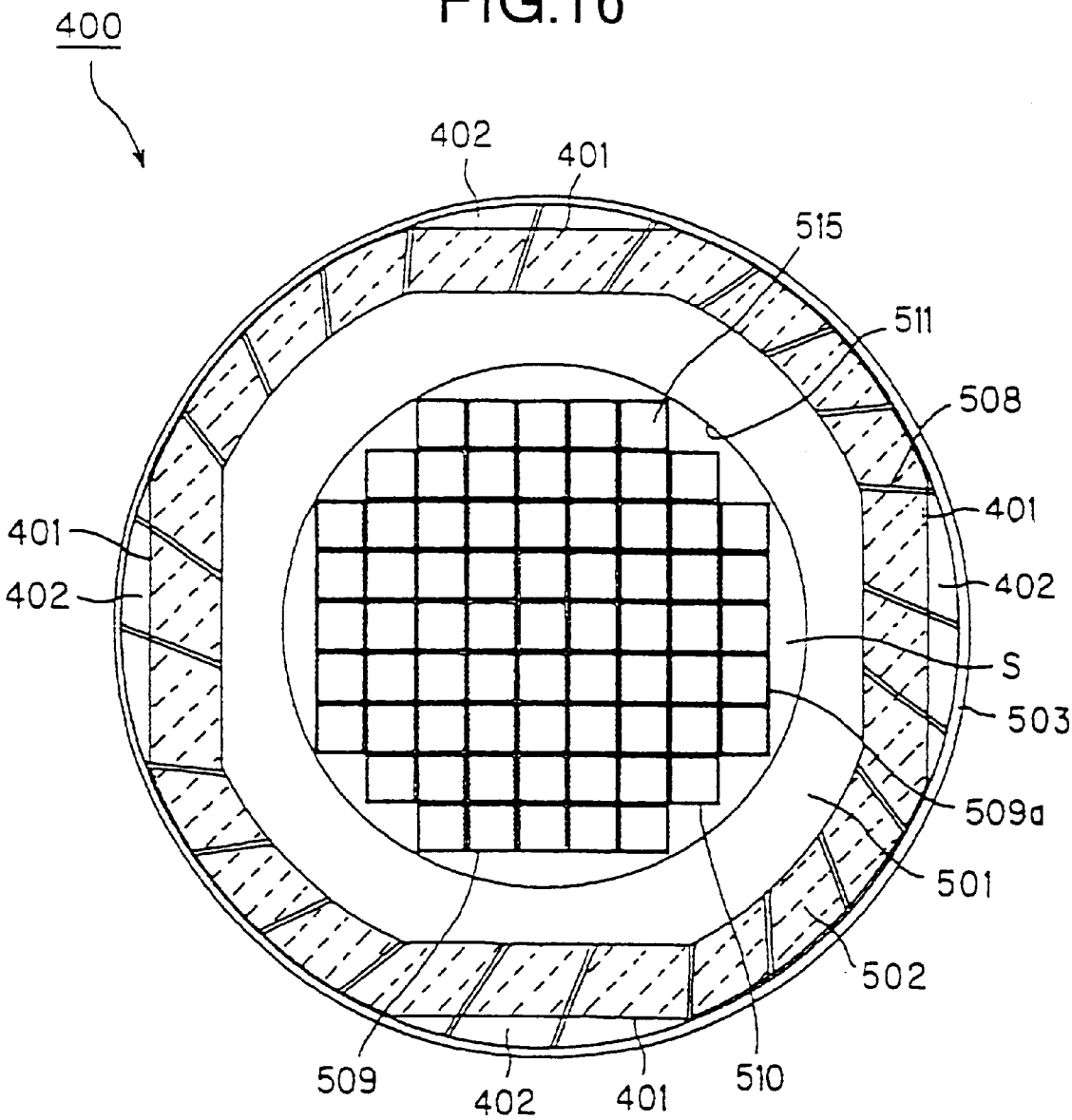
FIG. 16 is a radial section view showing a cask according to a third embodiment of the present invention.
Figure 17:
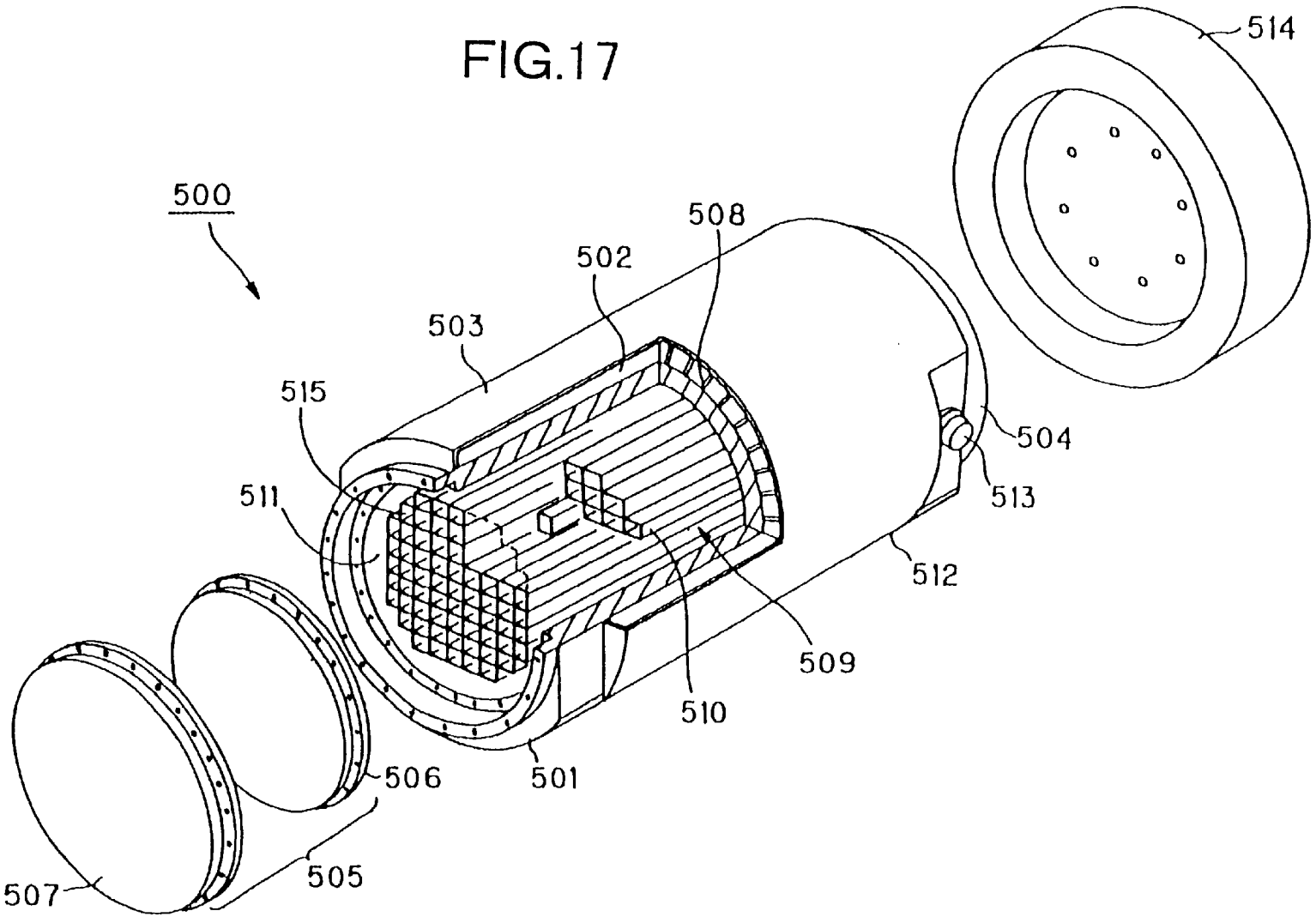
FIG. 17 is a perspective view showing one example of a cask.
Figure 18:
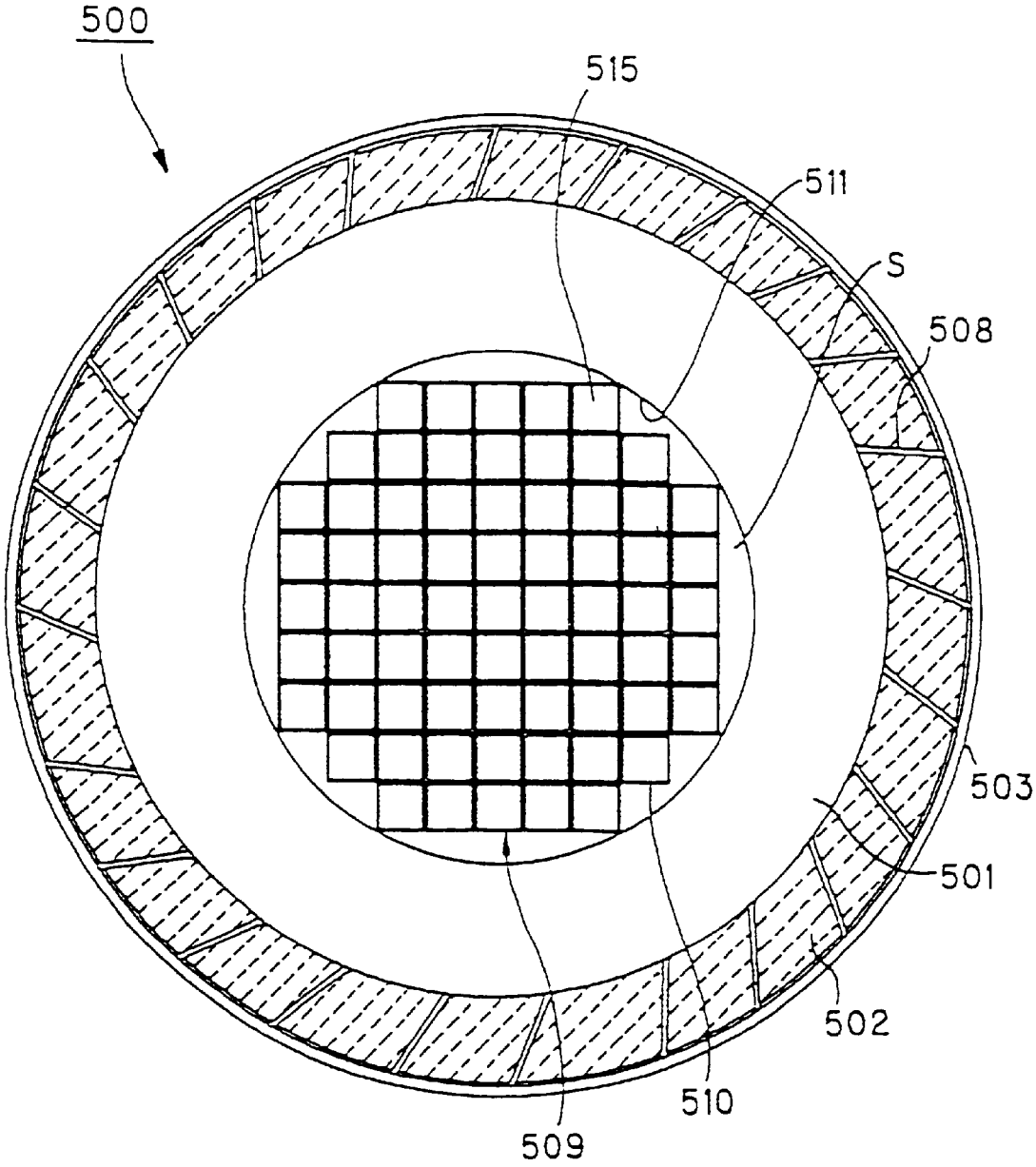
FIG. 18 is an axial section view of the cask shown in FIG. 17.

FIG. 16 is a radial section view showing a cask according to the third embodiment of the present invention. This cask 400 is such that on the outside of the barrel body 501 of the cask 500 shown in FIGS. 17 and 18 are provided four chamfered portions 401 at 90° intervals. Similar to the above, each chamfered portion 401 is provided so as to oppose to a flush portion 509*a* of the outside of the basket 509. This chamfered portion 401 is machine worked by the special working apparatus as described above.

Furthermore, the resin 502 is potted in close contact with the outside of the barrel body 501, however, it forms a space portion 402 at the position corresponding to the chamfered portion 401 between the outer casing 503 and the resin 502. This is because when the chamfered portion 401 is provided for the barrel body 501, the thickness of the resin 502 at that position becomes excessively large. By providing this space portion 402, it is possible to reduce the usage of the resin 502. As to other constituents, description will be omitted because they are similar to those of the cask 500. With such configuration, the cask 400 can be made lightweight and compact.

As described above, according to the cask of the present invention, since the outside shape of the barrel body is matched to the outside shape of the basket, it is possible to reduce the weight of the cask. Further, according to the cask of the present invention, since the outside shape of the barrel body and the inside shape of the cavity are matched to the outside shape of the basket, it is possible to make the cask lightweight and compact.

Also according to the cask of the present invention, since the shape of the neutron shielding member is matched to the outside shape of the basket, it is possible to make the cask compact and to reduce the usage of the neutron shielding member.

Also according to the cask of the present invention, since the inside shape of the cavity of the barrel body is matched to the outside shape of the basket, and the outside of the barrel body is worked so that the thickness necessary to shield gamma rays generated by the spent fuel assemblies accommodated in the cells is achieved, it is possible to make the cask lightweight and compact.

Also according to the cask of the present invention, since the neutron shielding member is formed on the outside of the barrel body so as to have an approximately uniform thickness, it is possible to reduce the excess neutron shielding member and to make the cask compact.

Also according to the cask of the present invention, since the outside shape of the barrel body is matched to the outside shape of the basket by providing a chamfer in the part having excess thickness for shielding gamma rays in the barrel body, it is possible to make the cask lightweight and compact.

Also according to the cask of the present invention, since the outside shape of the barrel body is matched to the outside shape of the basket by providing an auxiliary shielding member in the part where the thickness for shielding gamma rays is insufficient in the barrel body, it is possible to make the cask lightweight and compact.

Also according to the method of producing a cask of the present invention, an embedded form is arranged in the inner surface of the outer casing beforehand, and after potting the neutron shielding member, the embedded form is removed by heating, thereby forming an expansion margin or other space portions between the outer casing and the neutron shielding member. Therefore, it is possible to facilitate production of the cask.

Furthermore, since the embedded form of the present invention is a form for the expansion margin or other space portions to be formed between the outer casing and the neutron shielding member to be potted, and the form is formed of a thermoplastic material and a heater is embedded in the form, and the form is melt removed by heating the heater, it is possible to facilitate production of the cask.

Furthermore, since the embedded form of the present invention is formed by providing a thermoplastic material around a metal core and a heater is embedded in the metal core, the form can be easily recycled so that the production efficiency of the cask is improved.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A cask comprising:

a barrel body having an integrated forged structure, the barrel body shielding gamma rays, the barrel body having an inner and outer wall;

a shielding member provided outside the outer wall of said barrel body, the shielding member shielding neutrons and having an inner wall; and a basket having an angular cross section and a cellular structure, the cellular structure including cells each being formed with pipes having a square cross section, the pipes absorbing neutrons and said barrel body contacting the outer wall of said basket;

wherein substantially all of the outer wall of the basket is shaped so as to correspond with and contact the inner surface of said barrel body; and the inner wall of said shielding member contacts the outer wall of said barrel body, and wherein used fuel assemblies are accommodatible and storable in the cells.

2. The cask according to claim 1, wherein the cellular structure of the basket has plane sections and step-like sections, and a portion of the outer shape of the barrel body corresponding to the step-like sections of the basket is parallel to a line that connects the vertices of the step-like sections of the basket.

3. The cask according to claim 2, wherein adjacent pipes of the cells contact one another, and wherein the basket is in contact with the barrel body.

4. The cask according to claim 3, wherein the barrel body has a cavity formed therein and wherein an internal shape of the cavity in the barrel body corresponds with an outer shape of the angular cross section of the basket, the barrel body having an external shape having a plurality of corners and sides, wherein at least some of the sides of the barrel body are parallel to a line which connects vertices of an angular cross section of the basket.

5. The cask according to claim 4, wherein the shielding member is formed on an outside surface of the barrel body, and the shielding member has a uniform thickness.

6. The cask according to claim 2, wherein the barrel body has a cavity formed therein and wherein an internal shape of the cavity in the barrel body corresponds with an outer shape of an angular cross section of the basket, the barrel body having an external shape having a plurality of corners and sides, wherein at least some sides of the barrel body are parallel to a line which connects the vertices of the angular cross section of the basket.

7. The cask according to claim 2, wherein the shielding member has a shape corresponding to a shape formed when vertices of the angular cross section of the basket are connected.

8. The cask according to claim 1, wherein an outer shape of the barrel body corresponds to a shape formed when vertices of the angular cross section of the basket are connected by providing a chamfer in a part thereof where the thickness thereof is sufficient to shield gamma rays in the barrel body.

9. The cask according to claim 8, wherein adjacent pipes of the cells contact one another, and wherein the basket is in contact with the barrel body.

10. The cask according to claim 9, wherein an internal shape of a cavity in the barrel body corresponds with an outer shape of the angular cross section of the basket, the barrel body having an external shape having a plurality of corners and sides, wherein at least some sides of the barrel body are parallel to a line which connects vertices of an angular cross section of the basket.

11. The cask according to claim 10, wherein the shielding member is formed on an outside surface of the barrel body, and the shielding member has a uniform thickness.

12. The cask according to claim 8, wherein an internal shape of a cavity in the barrel body corresponds with an outer shape of an angular cross section of the basket, the barrel body having an external shape having a plurality of corners and sides, wherein at least some of the sides of the barrel body are parallel to a line which connects the vertices of the angular cross section of the basket.

13. The cask according to claim 8, wherein the shape of the shielding member corresponds to the shape formed when the vertices of the angular cross section of the basket are connected.

14. The cask according to claim 1, which comprises an outer casing positioned outside the shielding member and at least partially contacting the shielding member such that spaces are formed between said chamfered portions of the shielding member and the outer casing for reducing the thickness of the shielding member at the chamfered portions.

15. A cask comprising;

a barrel body having an integrated forged structure, the barrel body shielding gamma rays, the barrel body having a uniform thickness and having an inner and outer wall;

a shielding member provided outside the barrel body, the shielding member shielding neutrons and having chamfered portions; and a basket having an angular cross section and a cellular structure, the cellular structure including cells each being formed with pipes having a square cross section, the pipes absorbing neutrons and said barrel body contacting an outer wall of said basket;

wherein substantially all of the outer shape of the barrel body corresponds with a shape formed when the vertices of the angular cross section of the basket are connected such tat the basket is uniformly spaced from an inner surface of the shielding member, wherein used fuel assemblies are accommodatible and storable in the cells, spaces are formed between said chamfered portions of the shielding member and the outer casing for reducing the thickness of the shielding member at the chamfered portions and wherein at least a part of the outer wall of the basket is shaped so as to correspond with and contact the inner surface of said barrel body and the inner wall of said shielding member contacts the outer wall of said barrel body.

* * * * *